US009889061B1

(12) United States Patent
Trask

(10) Patent No.: US 9,889,061 B1
(45) Date of Patent: Feb. 13, 2018

(54) MULTI-FUNCTION CRUTCH AND METHOD OF USE

(71) Applicant: Lorelei Trask, Ontario (CA)

(72) Inventor: Lorelei Trask, Ontario (CA)

( * ) Notice: Subject to any disclaimer, the term of this patent is extended or adjusted under 35 U.S.C. 154(b) by 0 days.

(21) Appl. No.: 14/740,240

(22) Filed: Jun. 15, 2015

Related U.S. Application Data

(63) Continuation-in-part of application No. 13/830,429, filed on Mar. 14, 2013, now abandoned.

(60) Provisional application No. 62/085,073, filed on Nov. 26, 2014, provisional application No. 61/706,004, filed on Sep. 26, 2012.

(51) Int. Cl.
*A61H 3/02* (2006.01)

(52) U.S. Cl.
CPC ..... *A61H 3/02* (2013.01); *A61H 3/0288* (2013.01)

(58) Field of Classification Search
USPC ..... 135/66, 68, 86
See application file for complete search history.

(56) References Cited

U.S. PATENT DOCUMENTS 2,580,888 A * 1/1952 Burkett ..... A61H 3/02 135/66
2,857,925 A * 10/1958 Higginbotham ..... A45B 9/04 135/86
2,912,991 A * 11/1959 Shinn ..... A45B 1/00 135/66
4,526,187 A * 7/1985 Ciullo ..... A61H 3/02 128/DIG. 6
5,078,640 A 1/1992 Berman
5,101,846 A 4/1992 Greatwood
5,333,921 A 8/1994 Dimsmoor, III
5,343,375 A 8/1994 Gross et al.
D354,392 S * 1/1995 Williams ..... D3/10
5,752,535 A * 5/1998 Sanders ..... A61H 3/0288 135/68
6,026,833 A * 2/2000 Conte ..... A61H 3/02 135/66
6,165,035 A 12/2000 Avner
6,718,994 B2 4/2004 Lewis
7,243,667 B2 * 7/2007 Floriani ..... A61H 3/02 135/68
7,648,251 B2 1/2010 Whitehouse et al.
D654,682 S * 2/2012 White ..... D3/10
8,316,870 B2 * 11/2012 Morris ..... A61H 3/02 135/66

(Continued)

*Primary Examiner* — Sarah B McPartlin
(74) *Attorney, Agent, or Firm* — John J. Connors; Connors & Assoc. pc

(57) ABSTRACT

A crutch and method of carrying packages using such crutch are disclosed. The crutch comprises a plurality of metal poles connected together and covered by an insulating material. An outwardly extending finger element along an upper edge on a top of the crutch is configured to detachably mount a package having a hanging loop by draping the hanging loop on the finger element. The crutch includes side poles and a center pole sandwiched between the side poles. A pocket for receiving a package or other item is between the side poles and an enclosure holding a stretchable netting is mounted to the crutch and is configured to enable a user to withdraw the netting from the enclosure and wrap the netting around the package. The user detachably connects a free end of the netting to a portion of crutch to secure the package to the crutch.

12 Claims, 23 Drawing Sheets

(56) References Cited

U.S. PATENT DOCUMENTS

| | | | | |
|---|---|---|---|---|
| 8,388,214 | B1 | 3/2013 | Toro et al. | |
| 8,500,578 | B2 | 8/2013 | Mohr et al. | |
| 2011/0303714 | A1* | 12/2011 | Manson | A45B 1/00 224/576 |
| 2014/0096804 | A1* | 4/2014 | Keck | A61H 3/02 135/69 |

* cited by examiner

Fig. 3
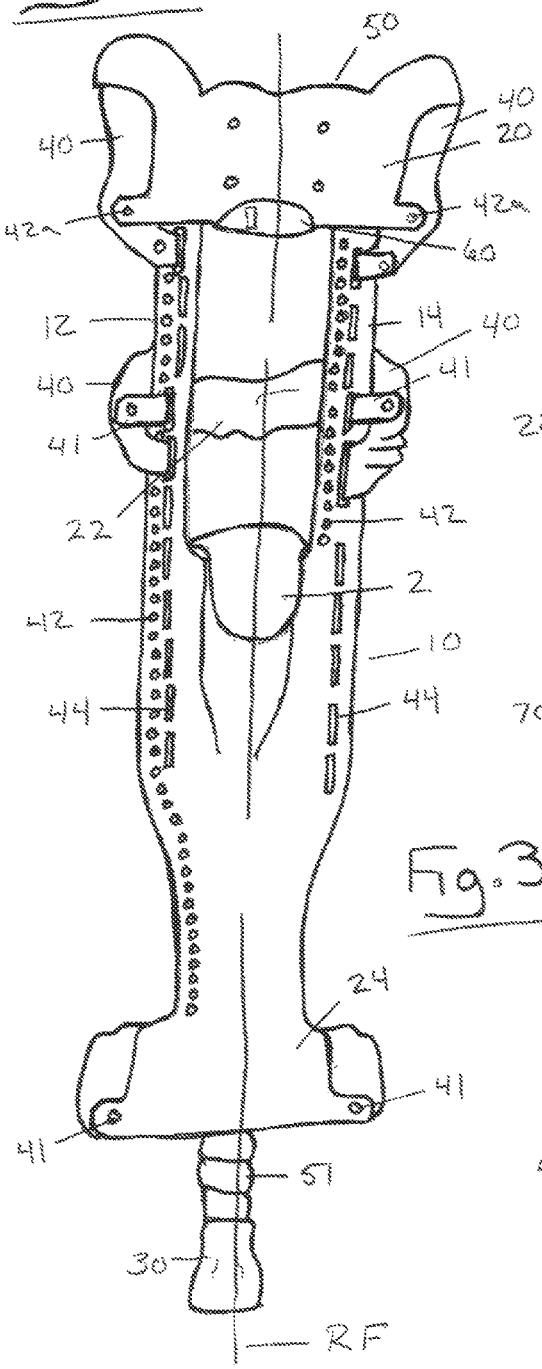
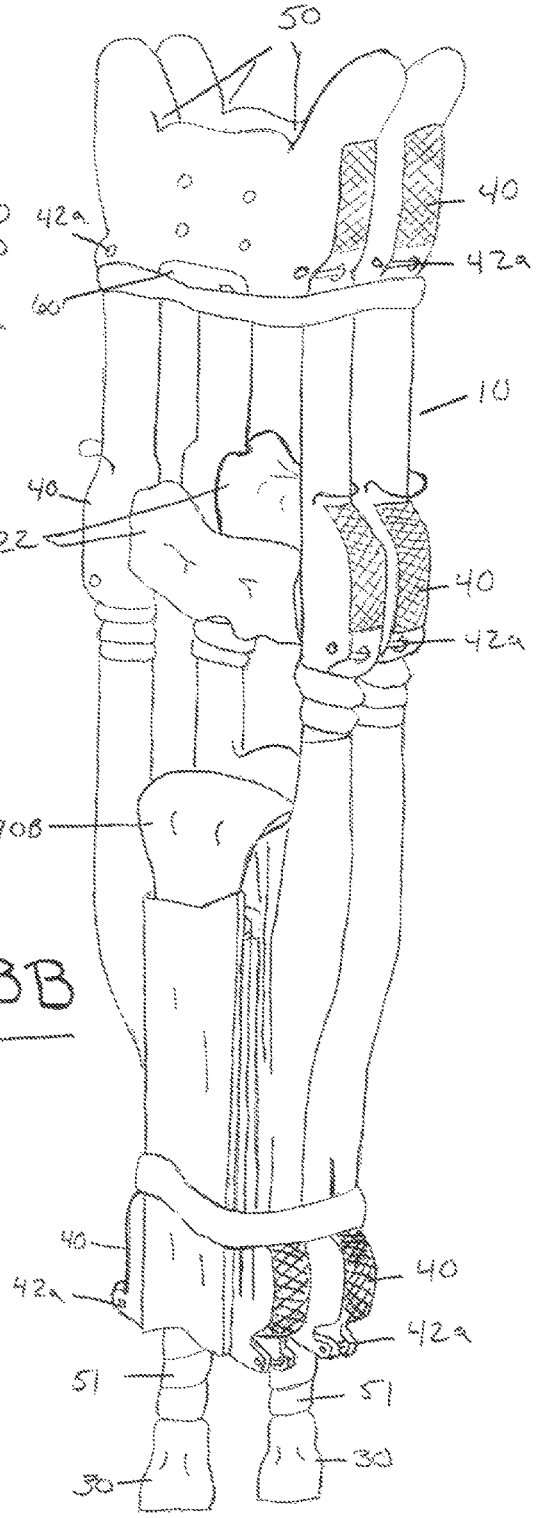
Fig. 3B

Fig. 3C
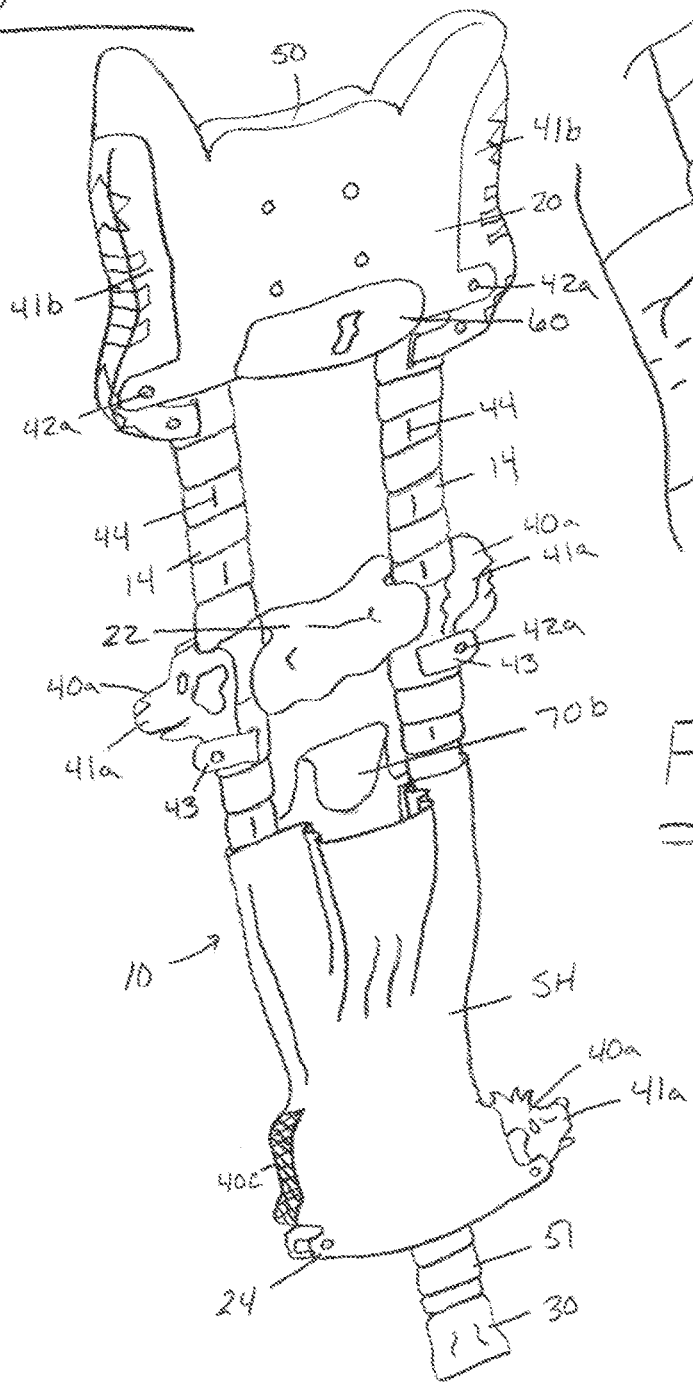
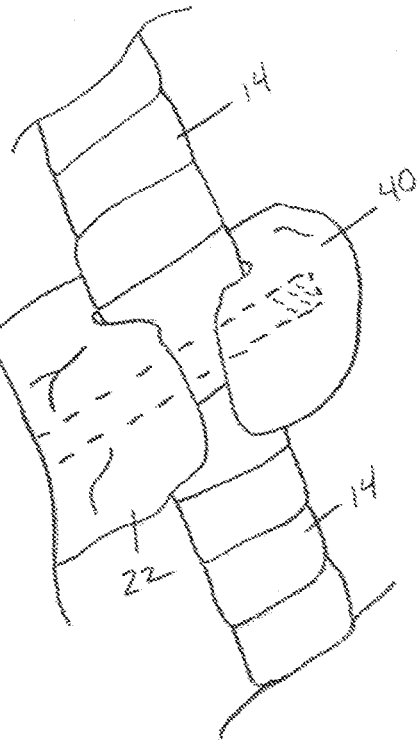
Fig 24E

Fig. 4
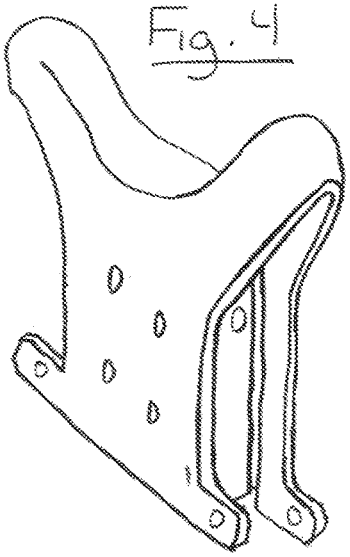
Fig. 4A
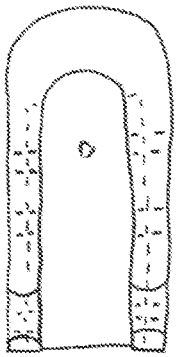
Fig. 4B
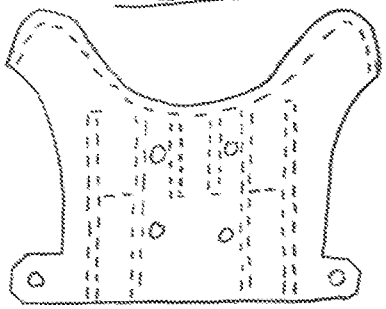
Fig. 4D
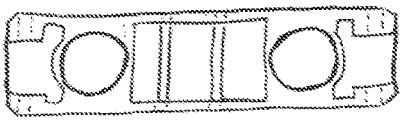
Fig. 4E
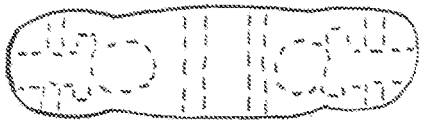
Fig. 4F
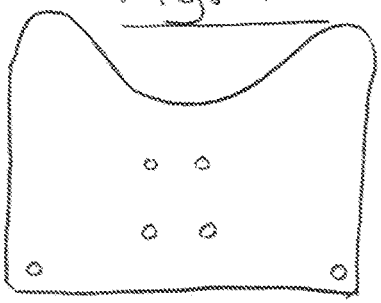
Fig. 4C
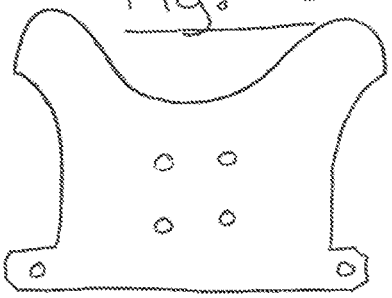
Fig. 4G
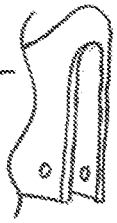
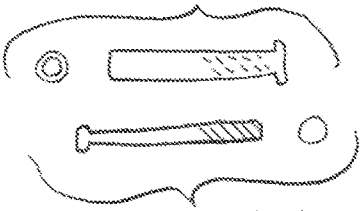
Fig. 4H 80
81
80a
ME
ME
B3
80b
82
SL
80c 80a
B3
80b
24

ME
80a
82
6C
B3
80
8d
81
80d
7
80c
24

ME
80
80a
81
82
80a
B3
80c
80c 80
81
80a
82
B3
ME
80c
80c
80b
24
40

43a
43
44
43
43b
SH1
20
41
51
45
45
44
43b
43
IM
H
IM
60
SH2
41

Fig. 24
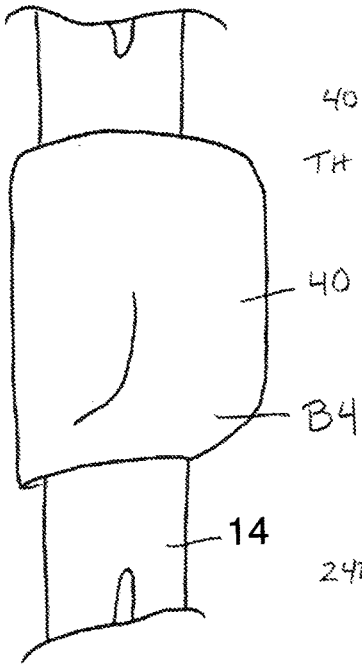
Fig. 24A
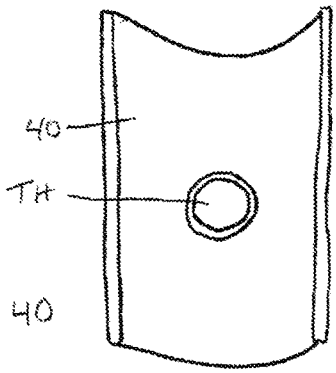
Fig. 24B
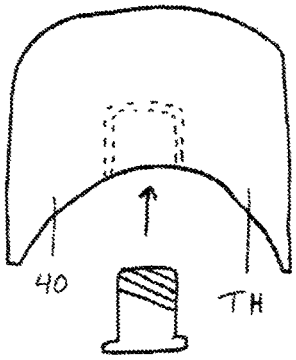
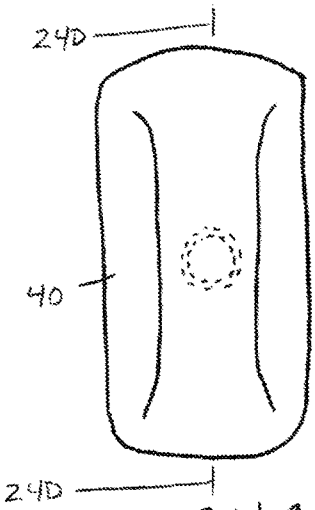
Fig. 24C
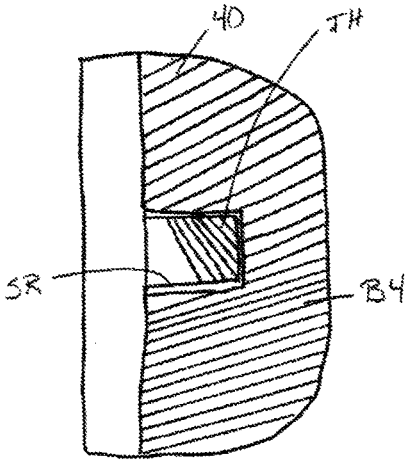
Fig. 24D Fig. 26
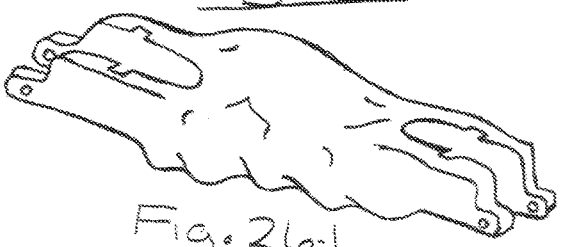
Fig. 26A
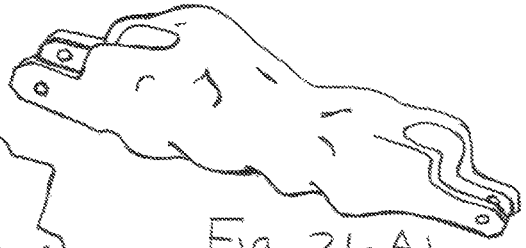
Fig. 26-1
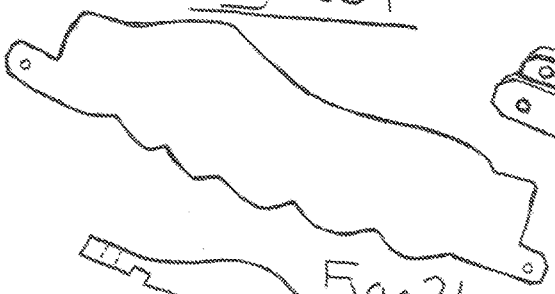
Fig. 26-2
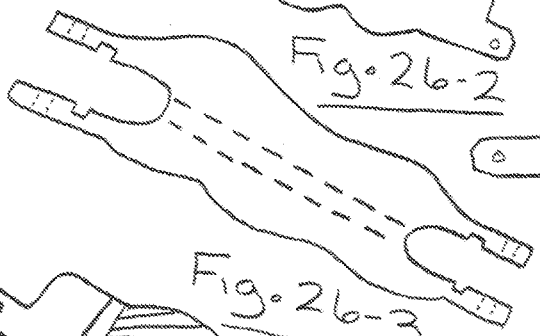
Fig. 26A-1
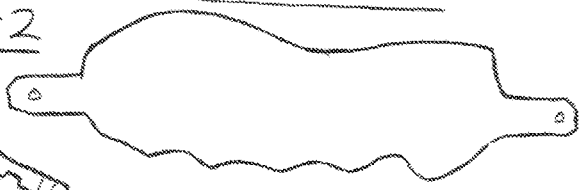
Fig. 26-3
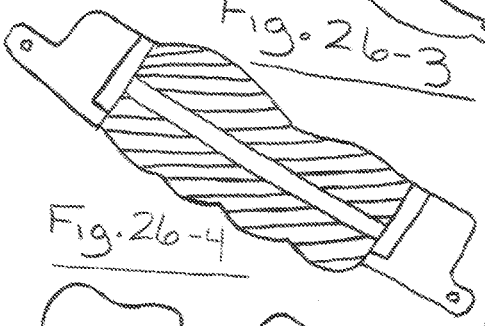
Fig. 26A-2
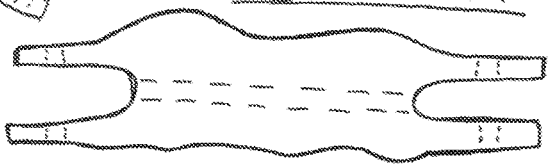
Fig. 26-4
Fig. 26A-3
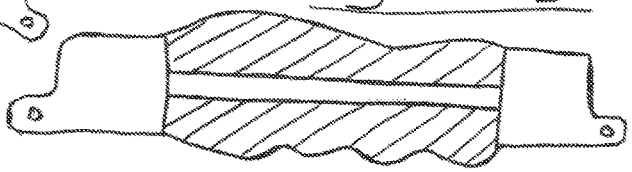
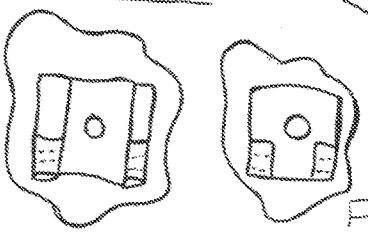
Fig. 26-A4

Fig 28
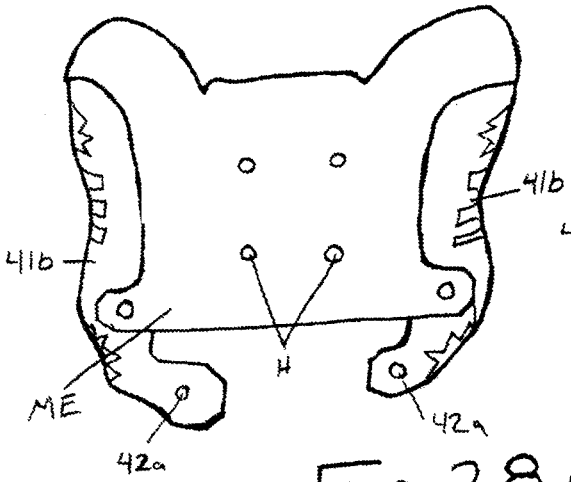
Fig 29
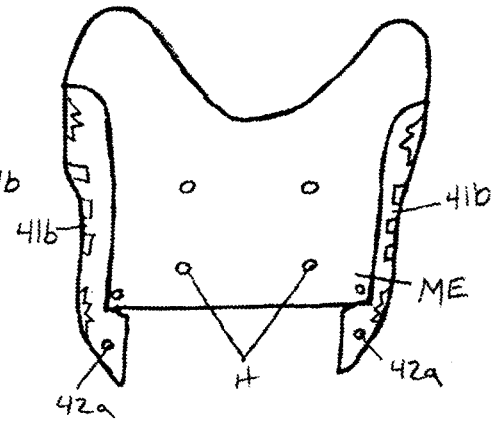
Fig 28A
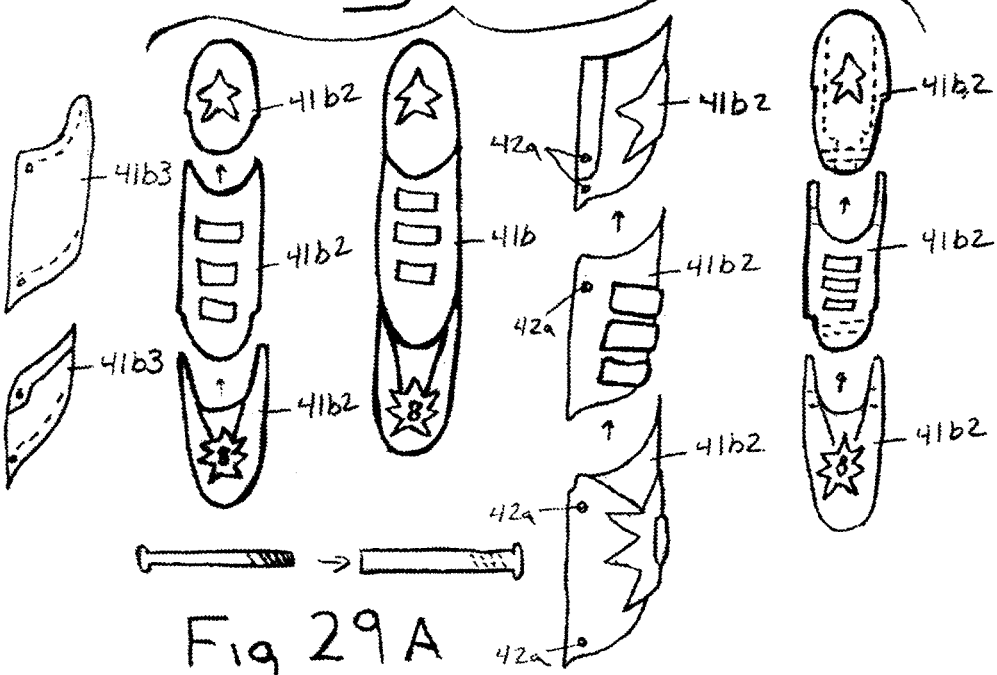
Fig 29A

Fig. 31
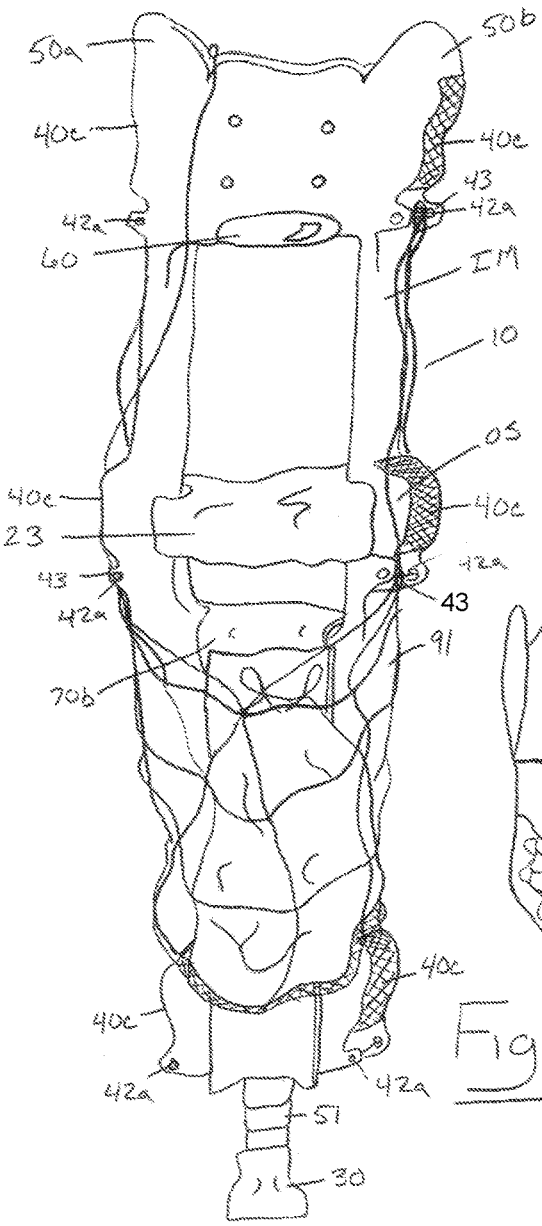
Fig. 32
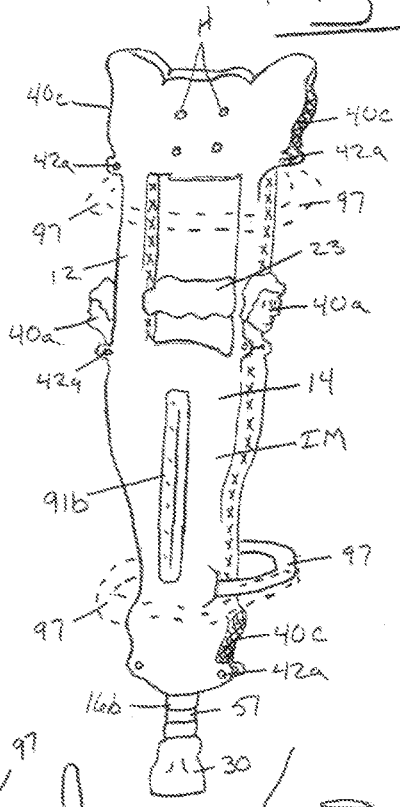
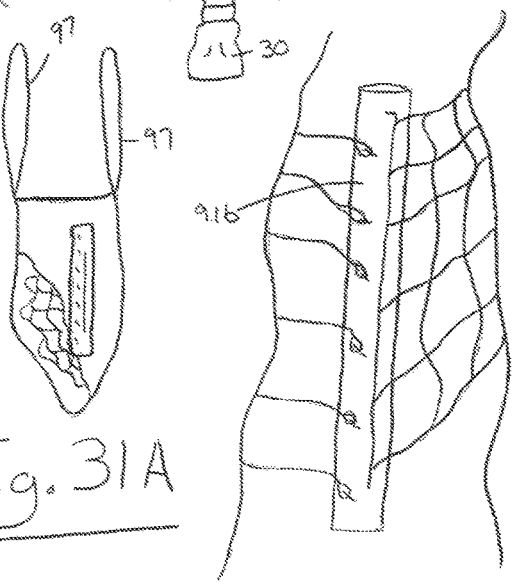
Fig. 31A

Fig. 34
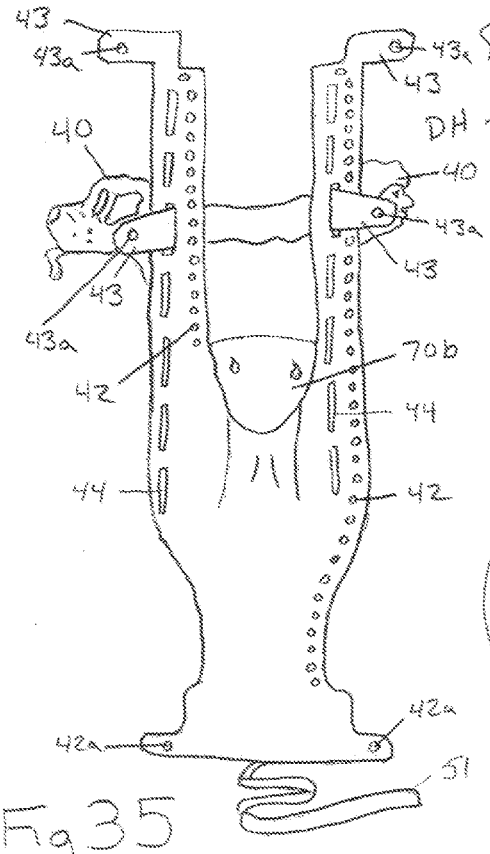
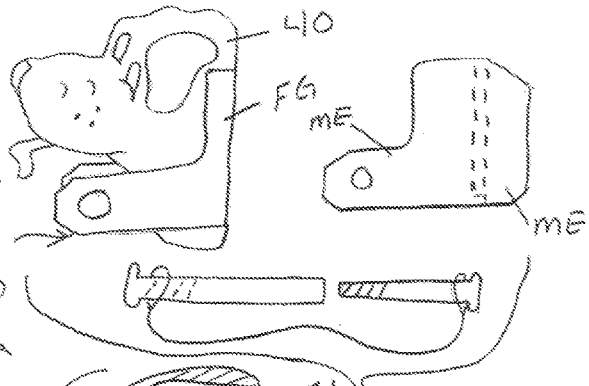
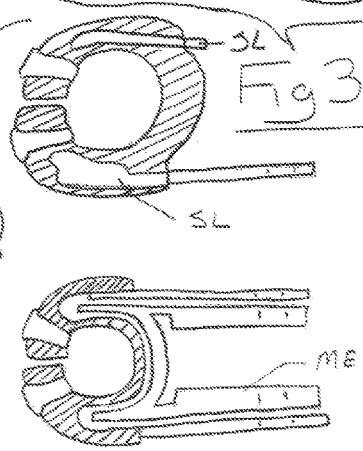
Fig 34A
Fig. 35B
Fig 35
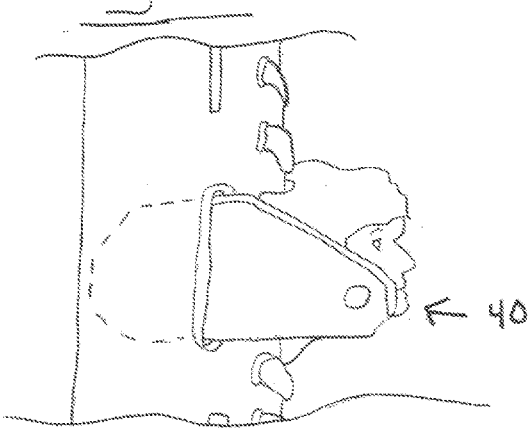
Fig. 35A
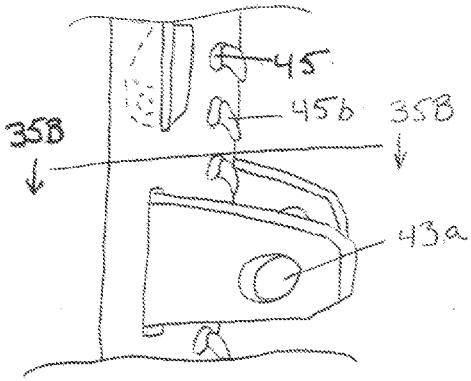

MULTI-FUNCTION CRUTCH AND METHOD OF USE

RELATED PATENT APPLICATIONS & INCORPORATION BY REFERENCE

This continuation-in-part utility application claims the benefit under 35 USC § 120 of U.S. utility patent application Ser. No. 13/830,429, filed Mar. 14, 2013, entitled Medical Equipment, and the benefit under 35 USC § 119(e) of U.S. Provisional Patent Application No. 62/085,073, filed Nov. 26, 2014, entitled Medical Equipment, Covers, Systems, Functions and Methods of Use, and U.S. Provisional Patent Application No. 61/796,004, entitled "Insulation, Heating, Cooling, Lighting of Durable Medical Equipment, Strollers and Outside Furniture and Methods of Use," filed Oct. 31, 2012. These related applications are incorporated herein by reference and made a part of this application. If any conflict arises between the disclosure of the invention in this utility application and that in the related applications, the disclosure in this utility application shall govern. Moreover, any and all U.S. patents, U.S. patent applications, and other documents, hard copy or electronic, cited or referred to in this application are incorporated herein by reference and made a part of this application.

BACKGROUND

Conventional crutches typically use metal poles connected together in a manner that exposes the metal surfaces of the poles. When current metal crutches are exposed to the elements, such as the sun, the crutch's become hot to extremely hot, it becomes very uncomfortable and may burn and injure the user or others. When a conventional, uninsulated crutch becomes cold to extremely cold, contact with the body of a user is very uncomfortable and may affect the user's health, such as, causing or exacerbating arthritis, fibromyalgia, aching associated within broken bones or other conditions a user may have. Many conventional crutches have a lock nut that secures a handle between a pair of metal poles of the crutch. The lock nut often accidently becomes ensnared in clothing or other articles. When the crutch bumps a user or someone else, or falls, the lock nut frequently injures the user, others, or both.

Definitions

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

SUMMARY

My is multi-functional and not only provides support in the conventional manner but prides several additional features. For example, my multi-functional crutch employs three conventional hollow metallic poles in an assembly that avoids using conventional lock nuts. Moreover, my crutch may be covered by an insulating material. Conventional crutches usually cover their handles with a pad that is very uncomfortable. Such pads tend to fall apart with use. Consequently, the user is left using an exposed, hard plastic handle until the less than optimal pad is replaced. This is a dangerous condition risking injury to the user's hands and wrist that my crutch avoids or minimizes. My multi-functional crutch has several other features depicted in the embodiments discussed in the section entitled "DETAILED DESCRIPTION OF SOME ILLUSTRATIVE EMBODIMENTS." The claims that follow define my multi-functional crutch and method of use, distinguishing them from the prior art; however, without limiting the scope of my crutch and method of use as expressed by these claims, in general terms, some, but not necessarily all, of their features are:

One, my crutch includes a pair of elongated, tubular metal side poles and an elongated, tubular metal center pole. The pair of side poles are of the same length and shape, and each pole has an upper portion terminating in a tip and a lower portion terminating in a tip. The center pole is positioned between the lower portions of the side poles and has an upper end portion and a lower end portion. Spaced apart connector elements attach together the side poles and center pole into an assembly where the center pole extends along a longitudinal central reference line and the side poles straddle said reference line. All the poles lie in the same plane and are parallel to each other. The assembly has opposed external side edges from which mounting elements project outwardly at a right angle to the longitudinal central reference line. A plurality of cap members are connected to the mounting elements.

Two, in one embodiment the cap members are designed to replace the lock-nut and secure the handle to in position. They are configured to reduce the likelihood of ensnaring an item that may contact the crutch. In a second embodiment the cap members may include one or more bumper structure comprising a resilient material. This bumper structure avoids injury if the crutch accidently falls against a user or another. In a third embodiment the cap members may one or more ornamental structure. In a fifth embodiment the cap members may include one or more battery-powered light. In a sixth embodiment the cap members may include one or more battery-powered audio device. The cap members may be detachable and configured to be interchangeably mounted along an edge of my crutch. The cap members may be detachable and configured to be interchangeably mounted along an edge of my crutch, and within the insulation material.

Three, my crutch may include a built-in or detachable enclosure holding a netting used to attach a package to the crutch. The package is placed against a distal side of the crutch and the withdrawn netting is wrapped around the package, pulling the package snug against the distal side. A free end of the netting is configured to detachably connect to a portion of the crutch to hold the package in place firmly against the distal side of the crutch.

Four, the crutch may include an enclosure holding a stretchable netting having one end fixed and another end free and adapted to be detachably connected to a portion of the crutch. The enclosure has an opening that allows a user to withdraw the free end of the netting through the opening.

Five, the lower end portion of the central pole terminates in a tip that is inserted into a tip cover. The tip cover has a body forming a receptacle with a floor and open mouth that receives the tip of the center pole. The floor has a hard surface that engages the terminal tip of the center pole upon insertion and prevents the terminal tip from cutting into the body, beneath the surface a honeycomb matrix of spaced apart open spaces in the body.

Six, the topmost connector element crutch may be shaped into an upper underarm support member having a predetermined external configuration. Specifically, an upper edge that terminates at opposed ends in outwardly projecting finger elements that are at an acute angle with respect to the reference line. The finger elements form between them an indentation in the upper edge, and the individual fingers meet the indentation at opposed ends of the indentation, forming individual junction grooves configured to assist in mounting a package on the crutch, proving a site to attach a free end of the netting.

Seven, a resilient pad member is between the topmost connector element and a top cover. The resilient pad member is positioned between the topmost connector element and a top cover and it cushions the crutch against the user's armpit.

Eight, the various components are configured with hole for mounting, connecting, locking, and securing.

Nine, the various components are configured to be interchanged and replaced.

These features are not listed in any rank order nor is this list intended to be exhaustive.

DESCRIPTION OF THE DRAWING

Some embodiments of my crutch and method of use are discussed in detail in connection with the accompanying drawing, which is for illustrative purposes only. This drawing includes the following figures (Figs.), with like numerals and letters indicating like parts:

FIG. 3B is a perspective view showing a pair of my crutches positioned next to each other with straps holding the pair together.

FIG. 3C is a perspective view showing a pair of my crutches positioned next to each other with straps holding the pair together.

FIG. 4A is an end view of the topmost connector element shown in FIG. 4.

FIG. 4B is a side view of the topmost connector element shown in FIG. 4, with internal structure shown in dotted lines.

FIG. 4C is a side view of the topmost connector element shown in FIG. 4, without internal structure shown in dotted lines.

FIG. 4D is a bottom end view of the topmost connector element shown in FIG. 4.

FIG. 4E is an top end view of the topmost connector element shown in FIG. 4.

FIG. 4F is an side view of an alternate embodiment of a topmost connector element without integral mounting members.

FIG. 4G is a fragmentary perspective view of the topmost connector element shown in FIG. 4F.

FIG. 4H is are side and end views of a disassembled fastener used with my crutch.

FIG. 11' is a top end view of the resilient pad member shown in FIG. 11.

FIG. 11" is a bottom end view of the resilient pad member shown in FIG. 11.

FIG. 11'" is a side end view of the resilient pad member shown in FIG. 11.

FIG. 11A' is a top end view of the resilient pad member shown in FIG. 11A.

FIG. 11A" is a bottom end view of the resilient pad member shown in FIG. 11A.

FIG. 11A'" is a side end view of the resilient pad member shown in FIG. 11A.

FIG. 19C is a rear view of a cap member for my crutch using a light shown in FIG. 19A.

FIG. 24 is a perspective view of a non-ornamental cap member mounted to a pole of my crutch.

FIG. 24A is an inside elevation view of the cap member shown in FIG. 24.

FIG. 24B is an exploded elevation view of the cap member shown in FIG. 24.

FIG. 24C is a front view of the cap member shown in FIG. 24.

FIG. 24D is a cross-sectional view of the cap member taken along line 24D-24D in FIG. 24C.

FIG. 24E is a perspective view of one connector member.

FIGS. 25-1, 25-1A, 25-1B, 25-1C depict four different views of an alternate embodiment of a mounting element that is configured to be attached directly to a pole of my crutch.

FIG. 26 is a perspective view of an intermediate connector element, a handle member that is mounted between side poles of my crutch.

FIG. 26-1 is a side view of the handle member shown in FIG. 26.

FIG. 26-2 is a top view of the handle member shown in FIG. 26.

FIG. 26-3 is a cross-sectional view of the cap member taken along line 26-3-26-3 in FIG. 26-2.

FIG. 26-4 is an end view of the cap member shown in FIG. 26.

FIG. 26A is a perspective view of another embodiment of an intermediate connector element, a handle member that is mounted between side poles of my crutch.

FIG. 26A-1 is a side view of the handle member shown in FIG. 26A.

FIG. 26A-2 is a top view of the handle member shown in FIG. 26A.

FIG. 26A-3 is a cross-sectional view of the cap member taken along line 26-3-26-3 in FIG. 26-2.

FIG. 26A-4 is an end view of the cap member shown in FIG. 26A.

FIG. 26B-1 is a side view of the handle member shown in FIG. 26B.

FIG. 26B-2 is a top view of the handle member shown in FIG. 26B.

FIG. 26B-3 is a cross-sectional view of the cap member taken along line 26-3-26-3 in FIG. 26-2.

FIG. 26B-4 is an end view of the cap member shown in FIG. 26B.

FIG. 28 is a rear view of another embodiment of a cap member for my crutch.

FIG. 28A shows assembled and disassembled components of the cap member employed with the topmost connector element shown in FIG. 28.

FIG. 29 is a front view of another embodiment of the topmost connector element that functions as an underarm support.

FIG. 29A shows assembled and disassembled components of the cap member employed with the topmost connector element shown in FIG. 29.

FIG. 31 is a view of the distal side of my crutch shown in FIG. 3A illustrating a stretchable netting wrapped around a package to secure the package to the distal side of my crutch.

FIG. 31A is a side view showing a detachable enclosure for the netting employed in the embodiment depicted in FIG. 3.

FIG. 32 is an exploded perspective view of showing a detachable enclosure illustrated in FIG. 31A showing the netting being wrapped around an enmeshed package and a portion of the crutch with a free end of the netting attached to finger at a topmost end of the crutch.

FIG. 34 is a fragmentary perspective view of an assembled rubber bumper structure attached to the handle member and an insulating sheath used with my crutch.

FIG. 34A depicts the components of attached to the insulating sheath shown in FIG. 34.

FIG. 35 is a assembled view of an alternate embodiment of a partially assembled rubber bumper structure attached along the insulating sheath but not the handle member.

FIG. 35A is a fragmentary perspective view of the alternate embodiment shown in FIG. 35 without the rubber bumper structure attached.

FIG. 35B is a cross-sectional view taken along line 35B-35B of FIG. 35A.

DETAILED DESCRIPTION OF SOME ILLUSTRATIVE EMBODIMENTS

Figure 1:
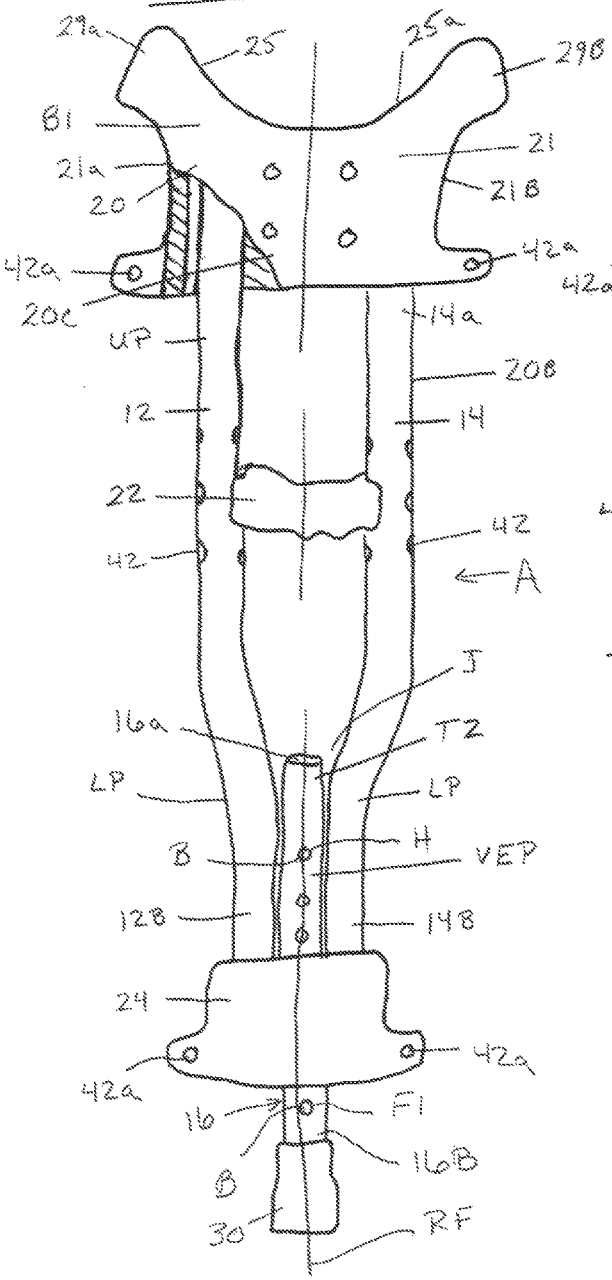
FIG. 1 is a side view of one embodiment of my crutch that is partially assembled without insulating material.
Figure 33A:
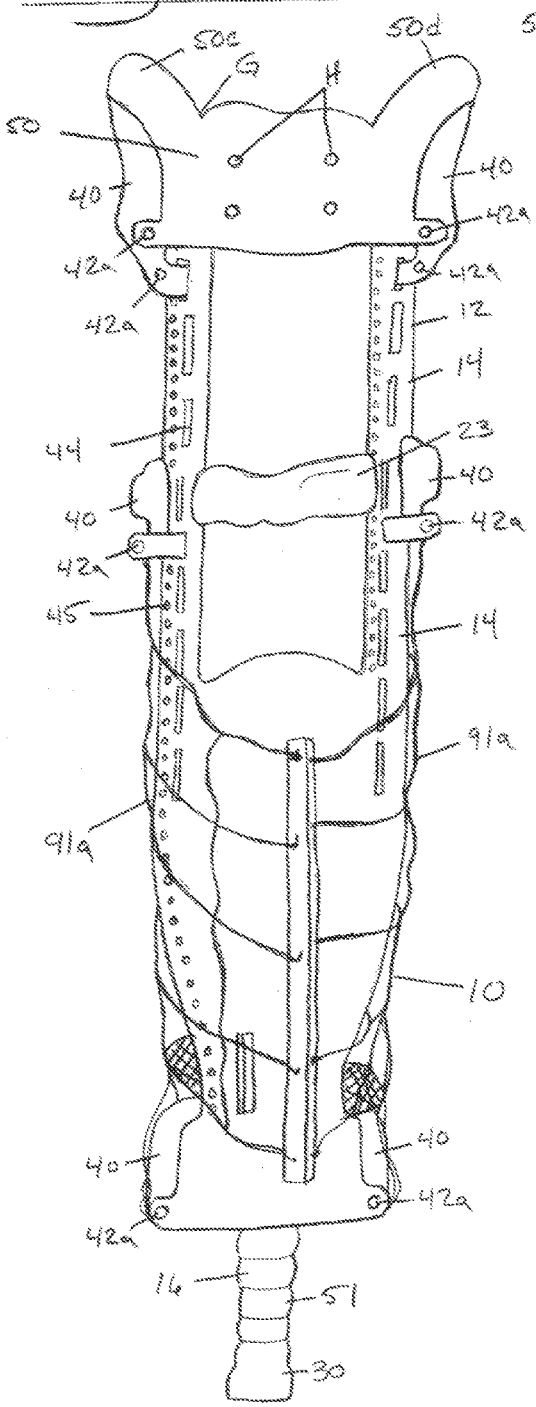
FIG. 33A is a proximal side view of the alternate embodiment shown in FIG. 32 with the netting withdrawn from the enclosure and wrapped around a lower portion of my crutch.
Figure 33B:
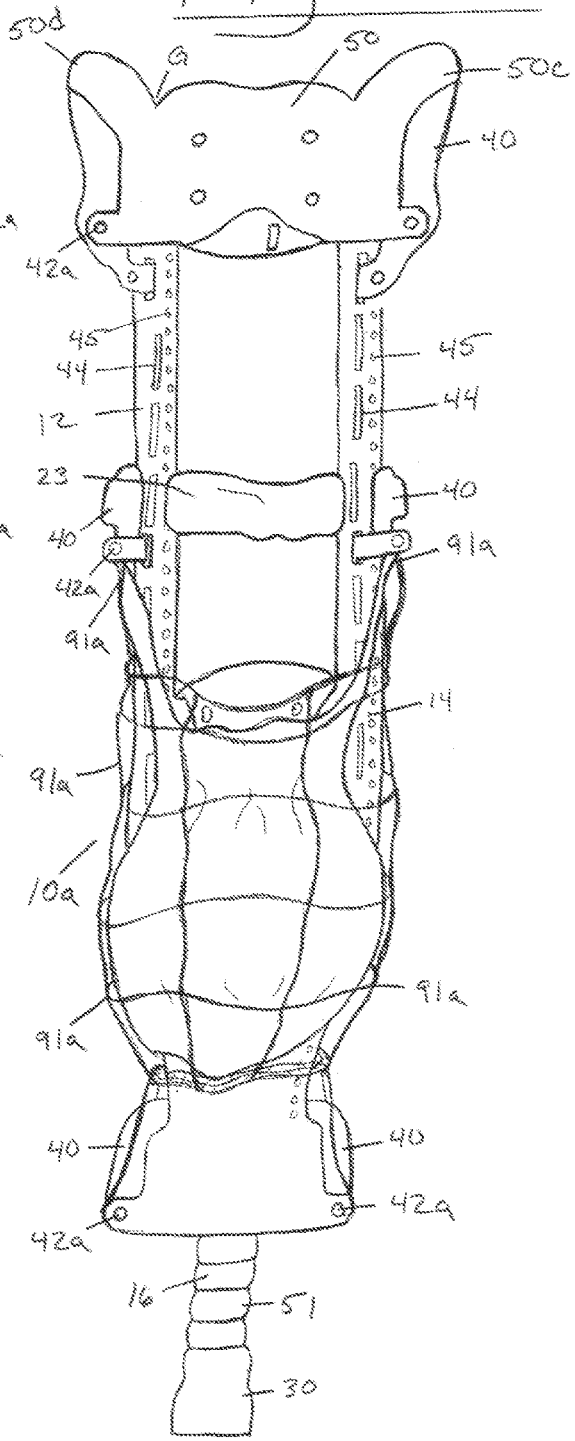
FIG. 33B is a distal side view of the alternate embodiment shown in FIG. 32 showing a package retained by the netting, holding the package firm against the distal side of the crutch.

My crutch, generally designated by the numeral 10, is best shown in FIGS. 3 and 3A-3C. An alternate embodiment is shown in FIGS. 32, 33A and 33B, and is generally designated by the numeral 10*a*. Both embodiments 10 and 10*a* includes a pair of elongated, tubular metal side poles 12 and 14 (FIG. 1) of the same length and shape, and an elongated, tubular metal center pole 16 (FIG. 1). The center pole 16 is of the telescoping type comprising an inner tube T1 within an outer tube T2 and moveable lengthwise. One spring loaded push button B of a series of buttons in the inner tube T1 engages an aligned hole H in a series of holes in the outer tube T2 to lock to tubes in a selected adjustable position. Both embodiments 10 and 10*a* facilitate my method of using my crutch to carry packages. For example, a user may detachably mount a package P having a hanging loop 9 to the crutch 10 shown in FIG. 3A by draping the hanging loop on an outwardly extending finger element 50*d* along an upper edge 50 on a top of the crutch. Alternately as depicted in FIGS. 31 and 32, a stretchable netting 91 may be used to retain a package on my crutch.

Figure 26B:
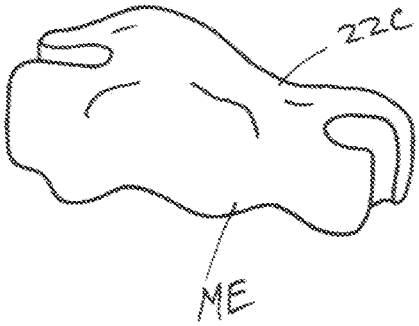
FIG. 26B is a perspective view of another embodiment of an intermediate connector element, a handle member that is mounted between side poles of my crutch.
Figures 1, 26B:
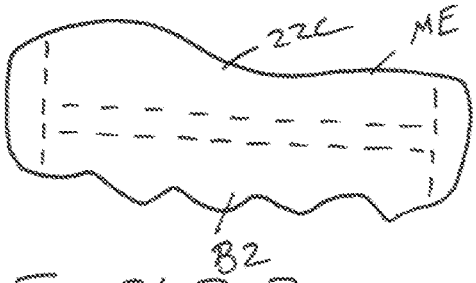
Figures 2, 26B:
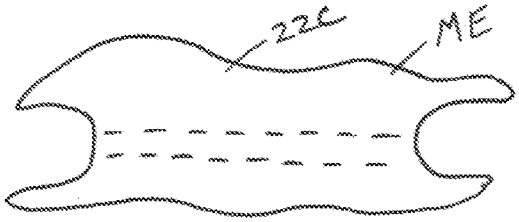
Figures 4, 26B:
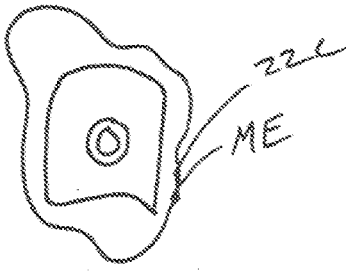
FIG. 4 is a perspective view of the topmost connector element used with my crutch having integral mounting members.
Figures 3, 26B:
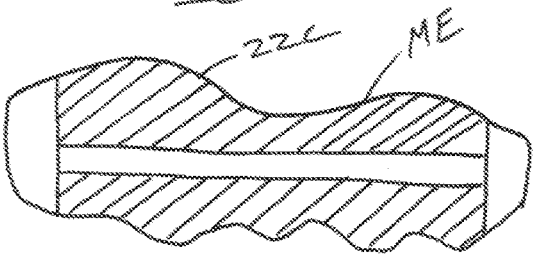
FIG. 3 is an outer side view of the one embodiment of my crutch fully assembled as depicted in FIG. 3A.

Spaced apart connector elements 20, 22, and 24 attach together the side poles 12 and 14 and the center pole 16 into an assembly A (FIG. 1) where the center pole 16 extends along a longitudinal central reference line RF and the side poles 12 and 14 straddle the reference line. As best depicted in FIG. 1, all the poles 12, 14, and 16 generally lie in the same plane and are parallel to each other. As shown in FIG. 3, each side pole 12 and 14 has an upper portion UP terminating in upper tips 12*a* and 14*a*, respectively, and a lower portion LP terminating in tips 12*b* and 14*b*, respectively. The center pole 16 is sandwiched between the lower portions LP of the side poles 12 and 14 and extends through the connector element 24, which functions as a lower support member and may be made of a resilient material such, as, for example, rigid plastic or hard rubber. To maintain in a selected position, the center pole 16 uses conventional depressible buttons B (FIG. 1) that interlock with a selected hole H as discussed above. The connector element 20 depicted in FIG. 4 includes opposed mounting elements.

Figure 30:
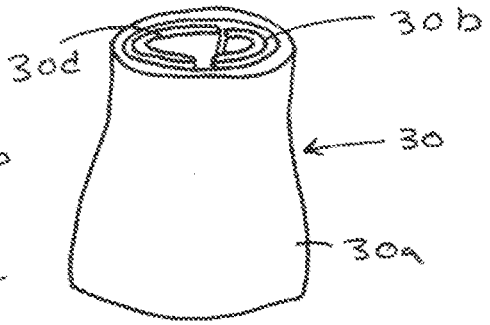
FIG. 30 is a perspective view of a tip cover mounted to an end of my crutch.
Figure 30B:
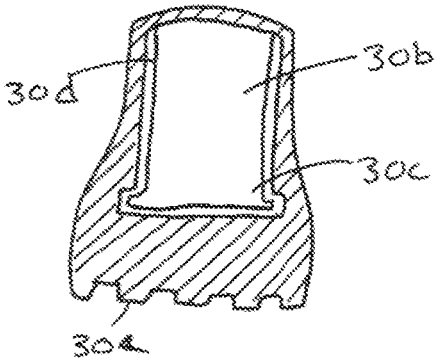
FIG. 30B is a cross-sectional view of an alternate embodiment of a tip cover for my crutch.
Figure 30A:
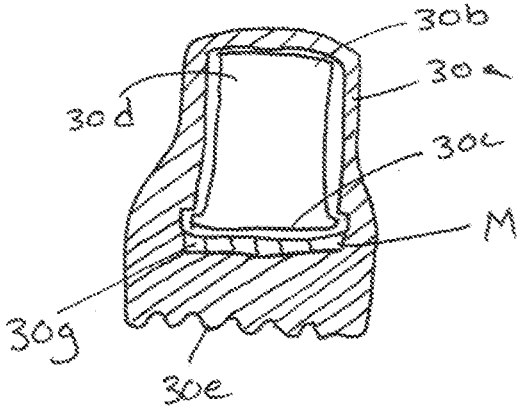
FIG. 30A is a cross-sectional view of the tip cover taken along line 30C-30C of FIG. 30.
Figure 30D:
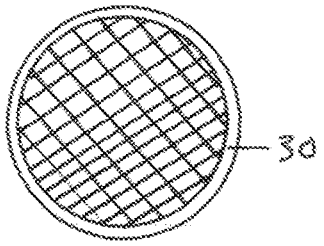
FIG. 30D is a bottom view of an alternate embodiment of a tip cover for my crutch.
Figure 30G:
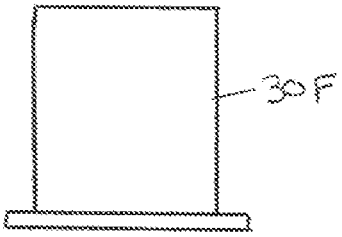
FIG. 30G is a side view.
Figure 30F:
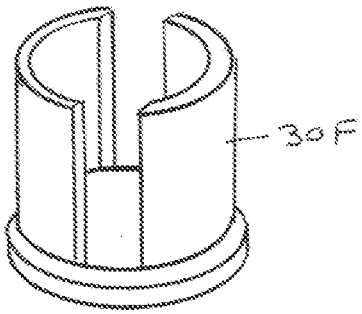
FIG. 30F is a perspective view of another component of the insert shown in FIG. 30E.
Figure 30H:
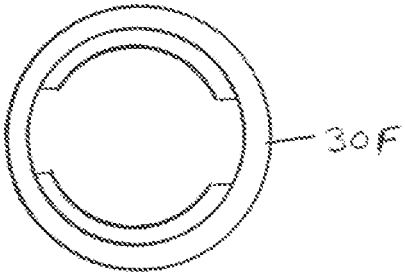
FIG. 30H is a side view.
Figure 30E:
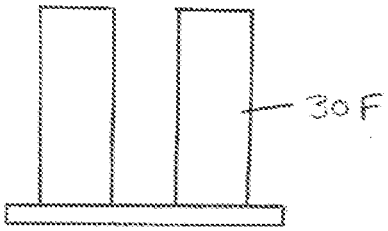
FIG. 30E is a side view component of an insert in the tip cover shown in FIG. 30.
Figure 30I:
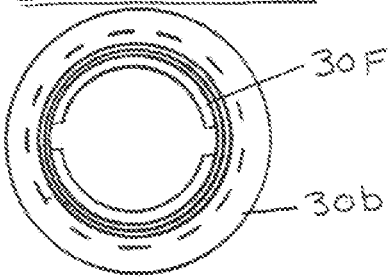
FIG. 30I is a side view
Figure 30C:
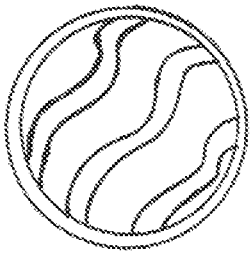
FIG. 30C is a bottom view of the tip cover shown in FIG. 30.

With the crutch 10 more or less vertically oriented, an upper end portion UEP (FIG. 1) of the center pole 16 is above the connector element 24 and below the connector handle element 22. The upper end portion UEP of the center pole 16 terminates at a junction J (FIG. 1) where an upper tip 16*a* of the center pole 16 meets the lower portions LP of the side poles 12 and 14. A lower terminal tip 16*b* of the center pole 16 is covered by a unique tip cover 30. The lower end portion LEP of the central pole 16 terminates in a tip 16*b* that is inserted into the tip cover 30 illustrated in FIGS. 30 and 30A through 30I. This tip cover 30 has a generally cylindrical body 30*a* forming at an end a receptacle 30*b* with a floor 30*c* and open mouth 30*d* that receives the terminal tip 16*b* (FIG. 1) of the center pole 16. The opposed bottom end 30*e* of the tip cover 30 is closed. The floor 30*c* may be part of a metal cup 30*h* that fits snug in the receptacle 30*b* has a hard, flat surface 30*f* that engages the terminal tip 16*b* of the center pole 16 upon insertion and prevents the terminal tip from cutting into the body 30*a*. In the embodiment shown in FIG. 30A, beneath the surface 30*f* is a honey comb matrix M of spaced apart open spaces 30*g* the said body 30*a*.

As shown in FIG. 1, the connector element 20 is an underarm support member comprising a body B1 having a bottom edge 20*b* including a pair of open receptacles 20*c* (only one shown) at outer ends of the bottom edge into which the tips 12*a* and 14*a* of the upper end portions of side poles are individually inserted. The body B1 may be made of a rigid plastic or a hard rubber molded into a unique configuration as discussed subsequently in greater detail. The side poles 12 and 14 at lower portions LP are bent inward towards each other and the upper end portion UEP of the center pole 16 is sandwiched between the inwardly bending lower portions of the side poles. The underarm support member body B1 has a predetermined external configuration including opposed flat parallel faces 21 (only one shown) between inwardly tapering side edges 21*a* and 21*b*, an upper edge 25 terminating at opposed ends in outwardly projecting finger elements 29*a* and 29*b* that are at an acute angle with respect to the reference line RL. The finger elements 23*a* and 23*b* form between them an indentation 25*a* in the upper edge 25.

Figure 22:
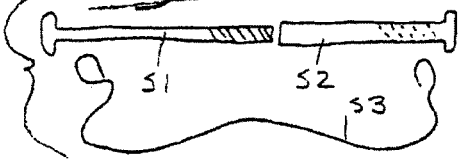
FIG. 22 is non-assembled screws and lock for attaching the handle member between the side poles.
Figure 23:
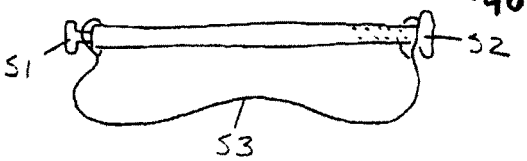
FIG. 23 is an assembly of the screws and lock shown in FIG. 22.
Figure 25A:
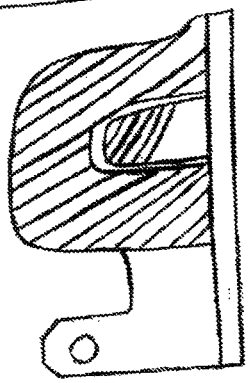
FIGS. 25A, 25B and 25C depict three different views of one embodiment of a mounting element that is configured to be attached directly to a pole of my crutch.
Figure 25B:
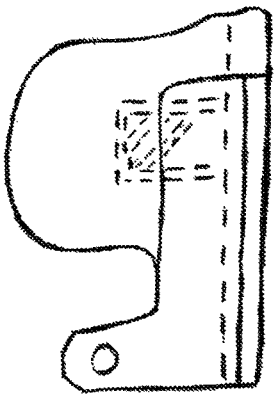
Figure 25C:
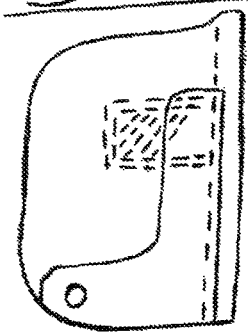
Figures 1, 25:
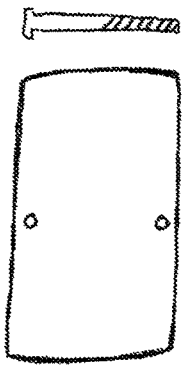
Figures 1A, 25:
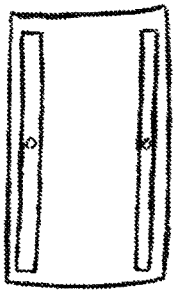
Figures 1C, 25:
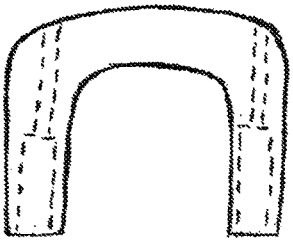
Figures 1B, 25:
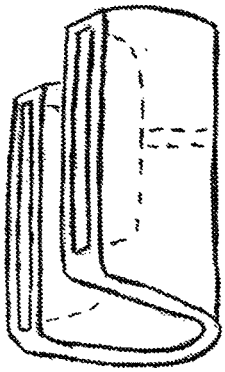

The connector element 22 functions as a handle member, also identified by the numeral 22 since they are the same component. It may be adjustably positioned intermediate the underarm support member 20 and the lower connector element 24, and it extends across the reference line RF and connects the poles 12 and 14. The handle member 22 typically is at a right angle with respect to the reference line RF. As best shown in FIGS. 26, 26A, and 26B, three embodiments of the handle member, identified respectively by the numerals 22, 22*a*, and 22*b*, are each a molded rubber or silicone structure having a body B2 of predetermined shape configured to conform to the palm of a user gripping the handle member. The body B2 is a rigid, tough material, and it may be covered by an outer layer of softer foam material. The handle members 22 and 22*a* have mounting elements ME formed at opposed ends. They may be molded or otherwise configured to connect to cap members as discussed subsequently. The handle member 22 and center pole 16 may be mounted to be manually repositioned to accommodate users of different heights. In other words, center pole 16 may be moved along the reference line RL into different selected vertically positions and then connected by opposed screws s1 and s2 passing through aligned holes in the poles 12 and 14 and a passageway 19 extending through the handle member 22. As depicted in FIGS. 22 and 23, opposed fasteners s1 and s2 are locked in position. A wire s3 attached to ends of the fasteners s1 and s2 serves as a point of attachment for a free end 91*a* of a netting 91 as shown in FIGS. 33A and 33B.

Figure 14:
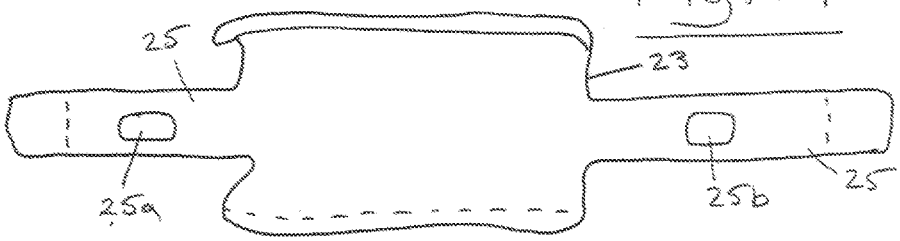
FIGS. 14, 15, 16A and 16B are different sized insulating, resilient detachable handle member covers.
Figure 15:
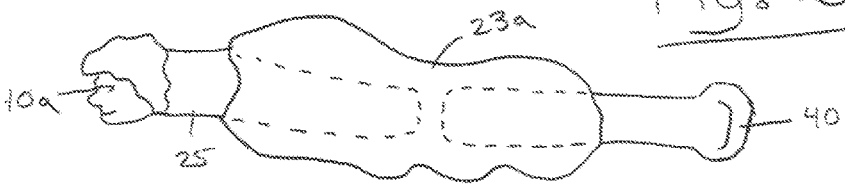
Figure 16A:
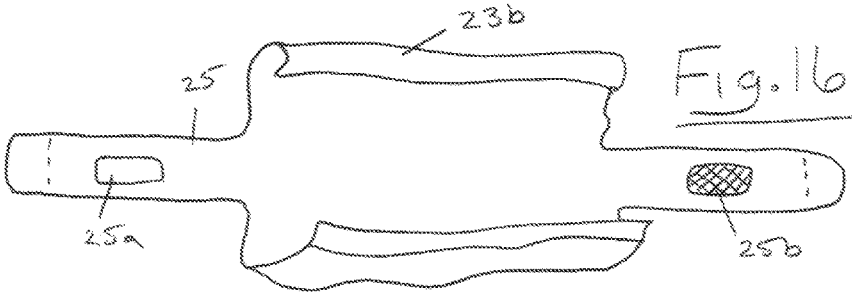
Figure 16B:
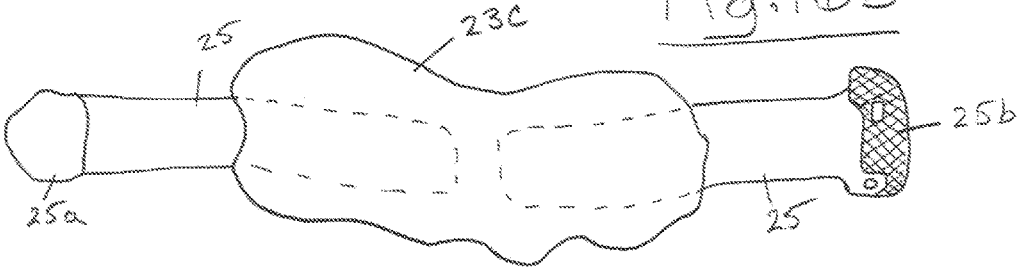

As shown in FIG. 14, a detachable handle cover 23 may be used to cover the handle member 22 as shown in FIGS. 3, 3A, 31, 32, 33A and 33B. This handle cover 23 may comprise a resilient fabric that fits snugly over and at least partially covers the handle member. Opposed ends of the handle cover 23 may have outward projecting straps 25 with end connectors 25*a* and 25*b* such as, for example, buttons, snaps, Velcro® two-part connectors. The handle cover 23 wraps around the handle member 22 and the ends of the straps are connected. Different sized handle covers 23*a* through 23 are shown in FIGS. 15 and 16A and 16B.

As best shown in FIGS. 5 and 6A through 6D, the connector element 24 has a body B3 molded from rubber. The body B3 has three parallel cylindrical opening 80, 81, and 82 in a top edge 80*a* of the body B3. The central opening

Figures 5, 6A, 6B, 6C, 6D, 7:
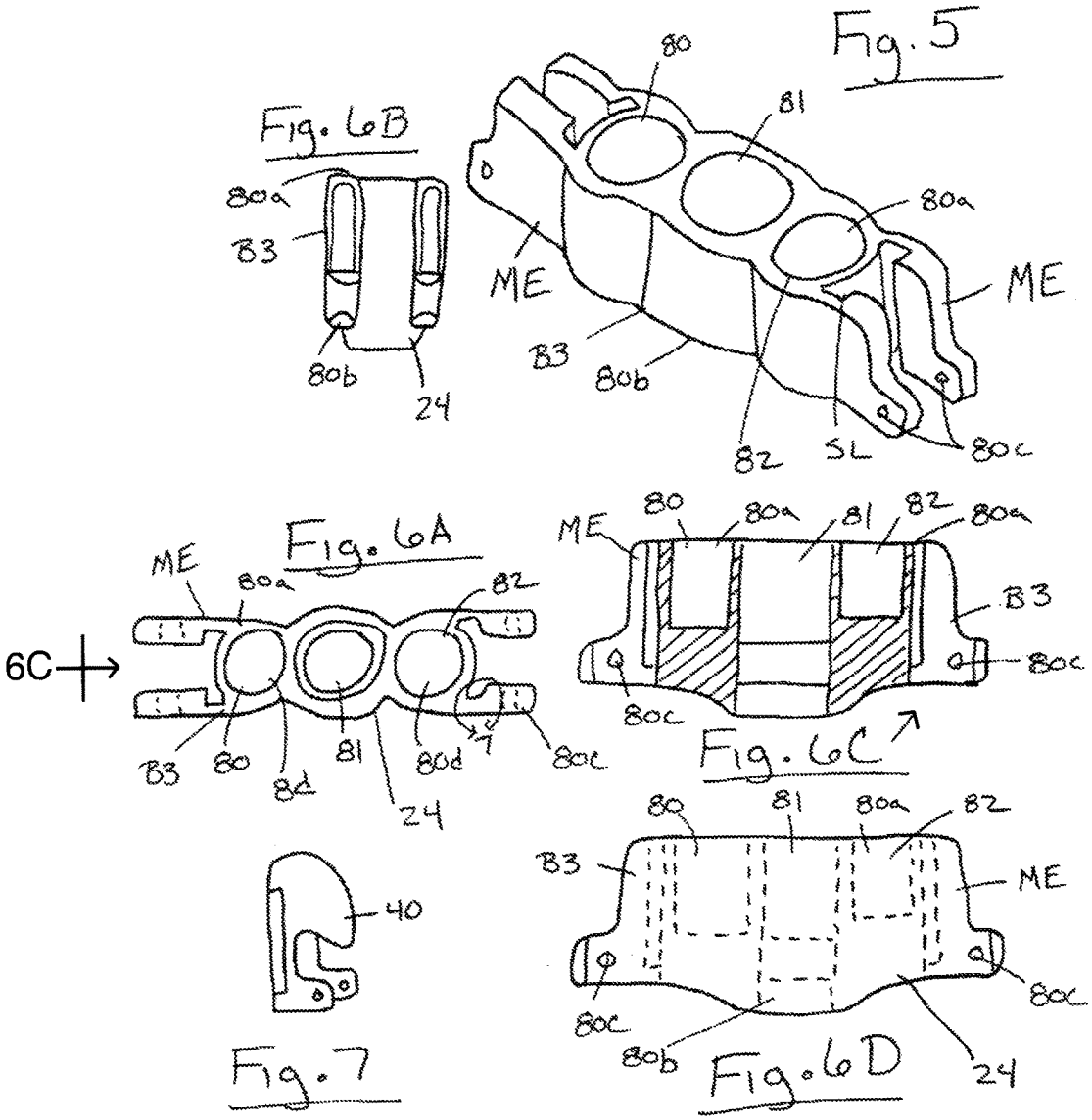
FIG. 5 is a perspective view of a lower connector support member.
FIG. 6A is a top plan view of the lower connector support member shown in FIG. 5.
FIG. 6B is an end view of the lower connector support member shown in FIG. 5.
FIG. 6C is a cross-sectional view taken along line 6C-6C of FIG. 6A.
FIG. 6D is a side view of the lower connector support member shown in FIG. 5.
FIG. 7 is a portion of the lower connector support member encircled by the line 7 in FIG. 6A.

81 extends through the body B2 to the bottom edge 80*b* of the body to allow the center pole 16 to pass through the element 24. The opening 80 and 82 each have closed flat floors 80*d* that act as stops to prevent the side poles 12 and 14 from passing through the body B3. At opposed outer sides Along the bottom edge 80*b* are opposed pairs of feet that each have aligned orifices 80*d* that receive fasteners such as, for example, bolts (not shown) that pass through these orifices when connecting the poles 12, 14, and 16 together during assembly of the crutch's components. FIG. 7 shows a cap member.

Figure 2:
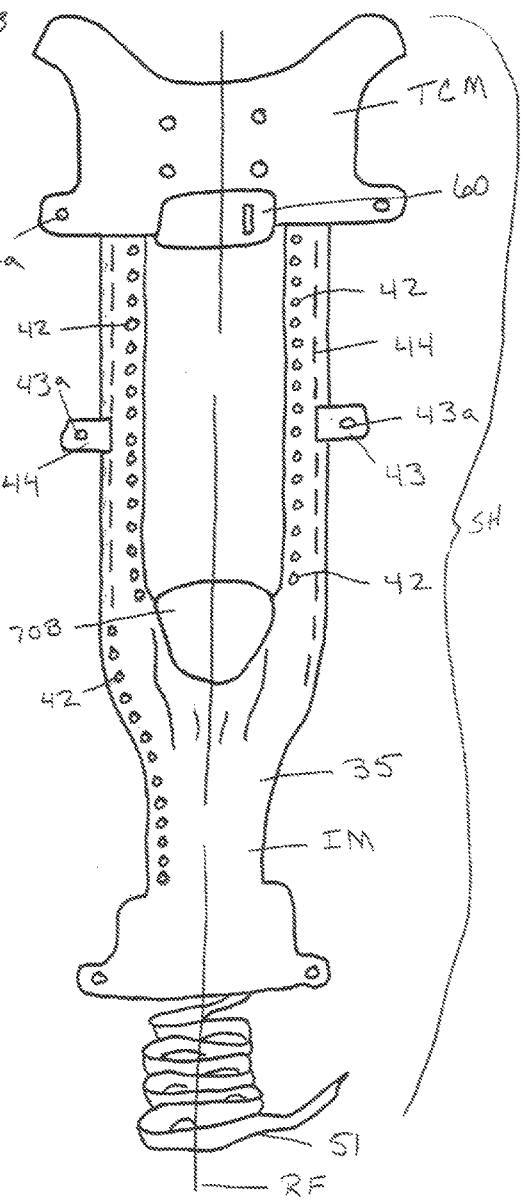
FIG. 2 is an side view of an insulating sheath to be attached to the assembled crutch components shown in FIG. 1.
Figures 10, 10A, 10B:
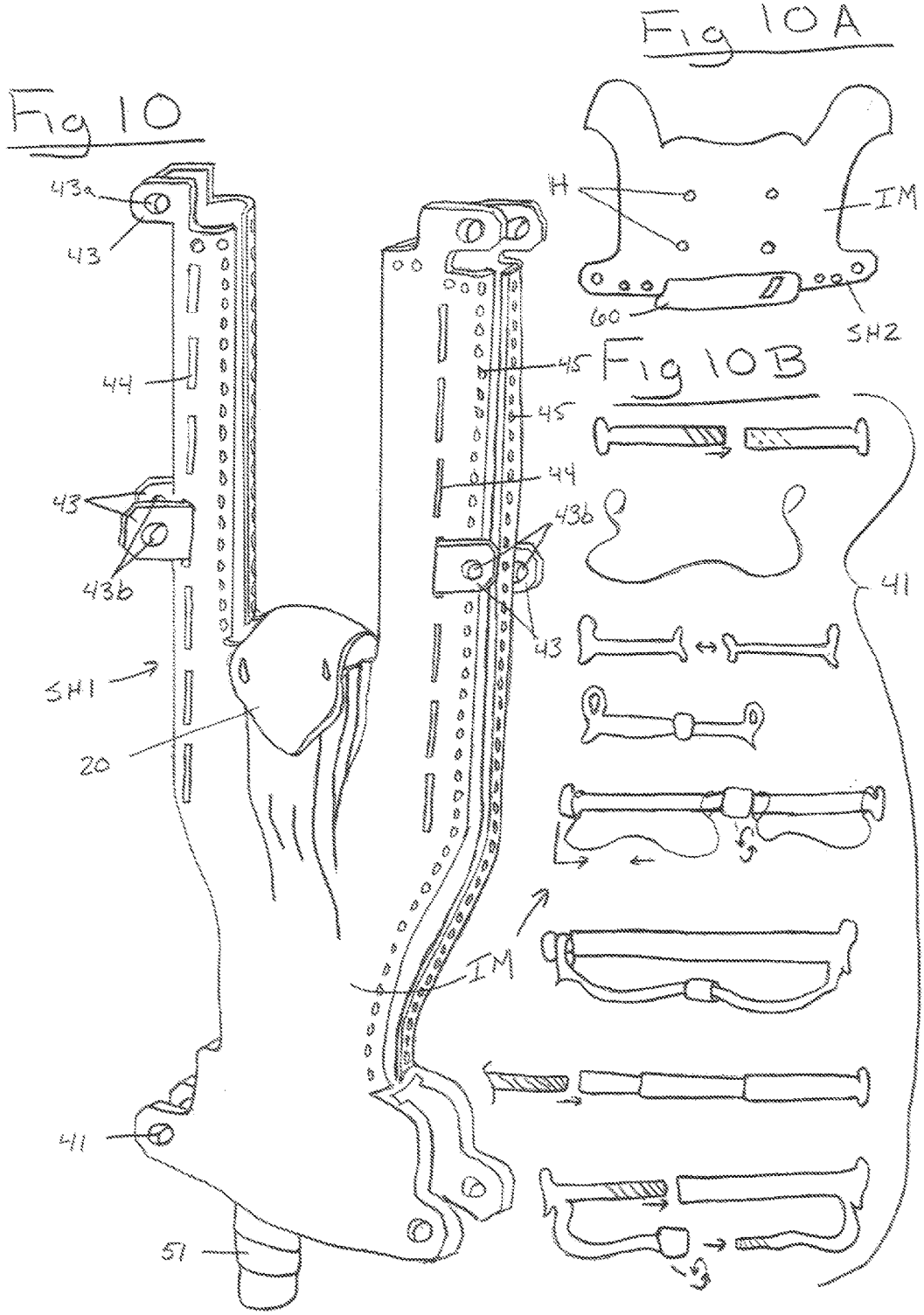
FIGS. 10 and 10A shows disassembled components of the insulating sheath shown in FIGS. 8 and 9.
FIG. 10B shows fasteners typically used to connect the components of my crutch.

One or more of the connector elements 20, 22, and 24 have external cap members 40 along the side poles 12 and 14. FIGS. 28A through 30A show two different shaped external cap members 41*a* and 41*b* that are attached by conventional fasteners 41 (FIG. 3) that pass through openings 42 in the insulting material IM and openings 42*a* (FIG. 1) in the connector elements 20, 22, and 24 to hold the assembly A together. A variety of different conventional fasteners 41 are illustrated in FIG. 10B may be used with my crutch. The insulting material IM may comprise of polyurethane foam and may be in the form of a sheet 35 (FIG. 4) having the general shape of the assembly A and it may include a series of slits 44. Openings along 45 along edge portions of the sheet of insulating material IM allow edge portions to be laced up with a string 45*a* (FIG. 35A) when wrapped around a portion of my crutch. As shown in FIGS. 10 and 10A, a sheath SH (FIG. 2) has, as shown in FIGS. 10 and 10A, two parts SH1 and SH2 that are laced together as depicted in FIG. 2.

Figure 3A:
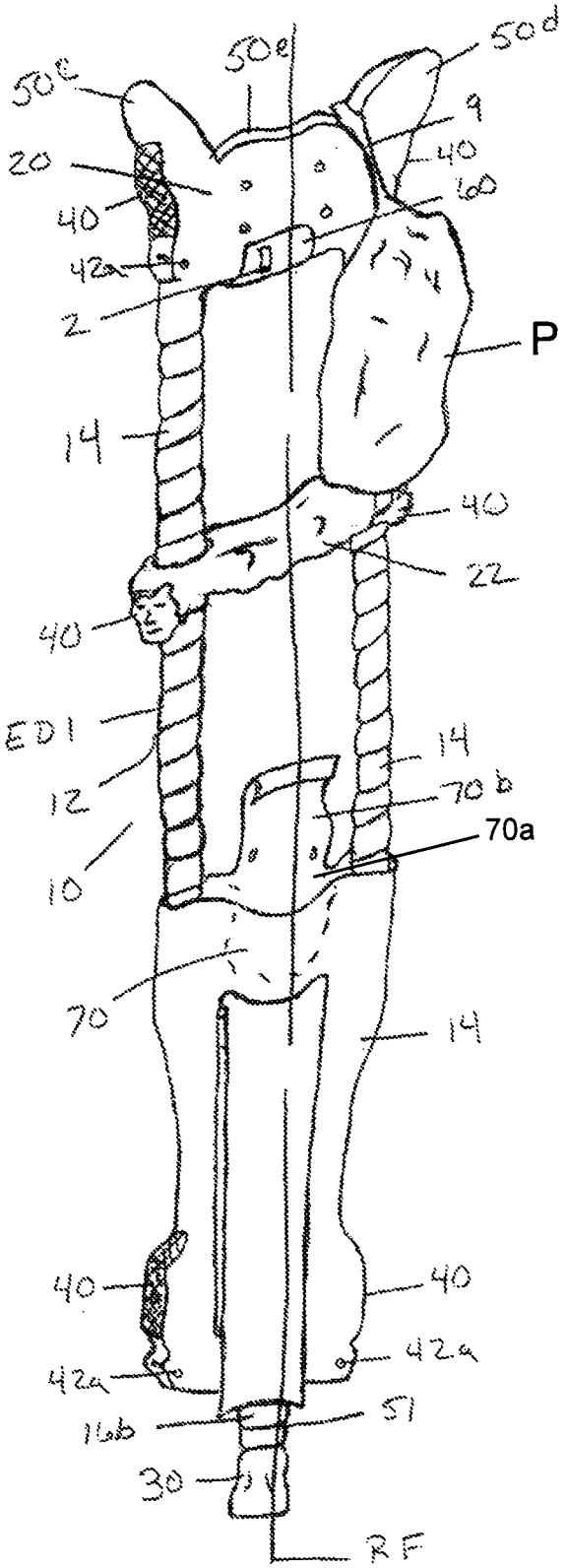
FIG. 3A is a perspective view showing an outer side of the one embodiment of my crutch shown in FIG. 3 as fully assembled with a package having a hanging loop detachably mounting the package to my crutch.
Figure 27:
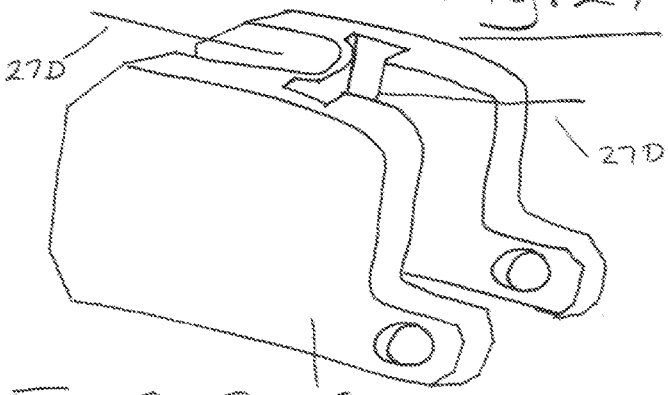
FIG. 27 is a perspective view of one embodiment of a mounting element used with my crutch.
Figure 27B:
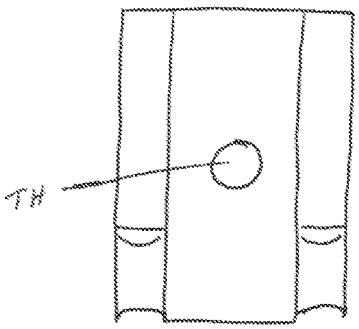
FIG. 27B is a front view of mounting element shown in FIG. 27.
Figure 27A:
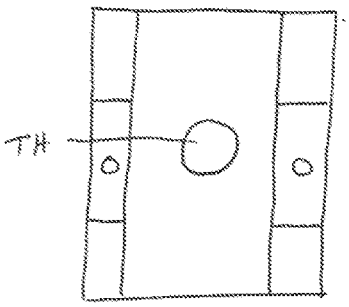
FIG. 27A is a rear view of mounting element shown in FIG. 27.
Figure 27E:
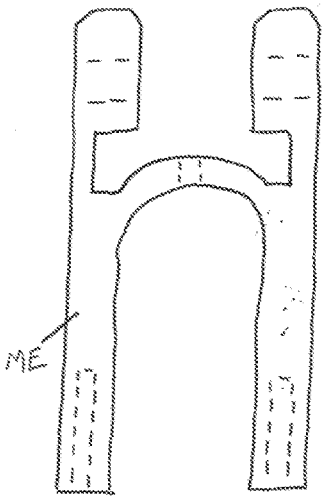
FIG. 27E is a top view of mounting element shown in FIG. 27.
Figure 27C:
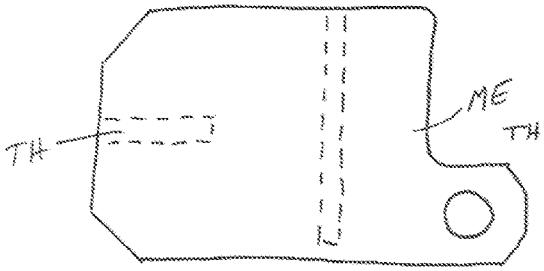
FIG. 27C is a side view of mounting element shown in FIG. 27.
Figure 27D:
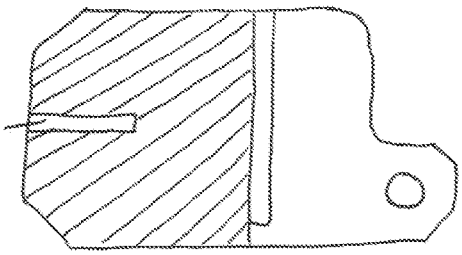
FIG. 27D is a cross-sectional view of taken along line 27D-27D.

One or more accessory cap members 40*a*, 40*b*, 40*c*, 40*d*, and 40*e*, respectively, shown in FIGS. 17A and 17B, 18A and 18B, 19A and 19B, 20A and 20B, and 21A and 21B, may be attached to any edge of either embodiment 10 or 10*a* of my crutch. Any cap member 40, 40*a*, 40*b*, 40*c*, 40*d*, and 40*e* may be attached to any edge of my crutch either to the edge directly as shown in FIG. 24, or a middle member shown in FIG. 34, or indirectly using a mounting member shown in FIGS. 25A through 25C, FIGS. 25-1 through 25-1C, and FIGS. 27 through 27E. For example, an accessory cap member 40 is attached to the mounting element ME shown in FIG. 27 by a conventional fastener as best shown in FIG. 3A. As shown in FIGS. 24 through 24D, a cap member 40 may be attached directly to a pole. This cap member 40 has a threaded hole TH in its body B4 that does not go completely through this treaded hole. A screw element (not shown) passes through an aligned hole (not shown) in the pole.

One or more cap member, for example, the dog head cap member 40 (FIG. 34A) is connected to a mounting element ME extending from an edge of the assembly A. This dog head cap member 40 cap member has a flange FG and the mounting element ME has a slot SL which facilitate attaching the cap member to the mounting element ME so a user can detach the cap member by sliding it along the slot and pulling it away from the crutch. The flange FG and slot SL are configured to enable the flange to slide into and from the slot.

Figure 17A:
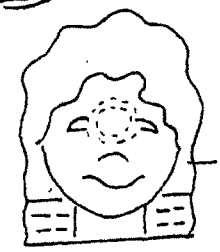
FIG. 17A is a front view of an ornamental, rubber bumper cap member for my crutch.
Figure 17B:
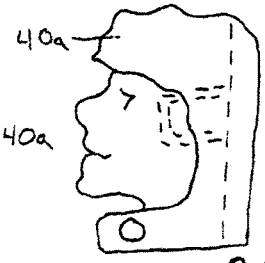
FIG. 17B is a side view of the bumper cap member for my crutch shown in FIG. 17A.
Figure 17C:
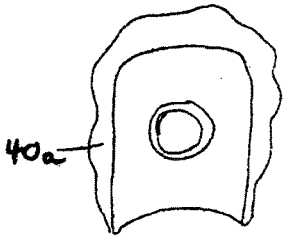
FIG. 17C is a rear view of the bumper cap member for my crutch shown in FIG. 17A.
Figure 19A:
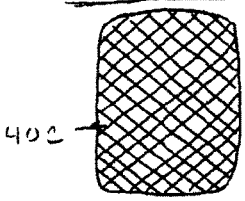
FIG. 19A is a front view of a cap member for my crutch using a light.
Figure 19B:
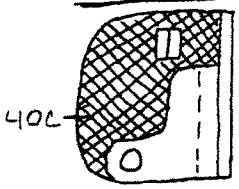
FIG. 19B is a side view of a cap member for my crutch using a light shown in FIG. 19A.
Figure 20A:
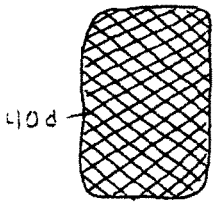
FIG. 20A is a front view of a cap member for my crutch using an audio device.
Figure 20B:
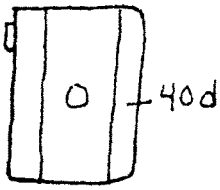
FIG. 20B is a side view of a cap member for my crutch using audio device shown in FIG. 20A.
Figure 21B:
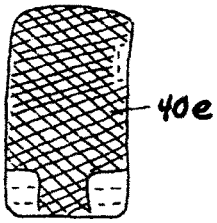
FIG. 21B is a side view of the bottom most connector element using a light shown in FIG. 21A.
Figure 18A:
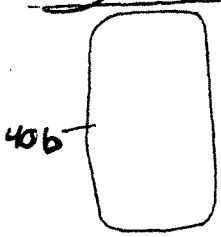
FIG. 18A is a front view of a non-ornamental cap member for my crutch.
Figure 18B:
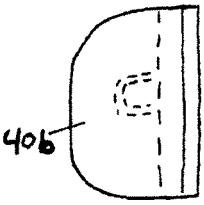
FIG. 18B is a side view of the non-ornamental cap member for my crutch shown in FIG. 18A.
Figure 18C:
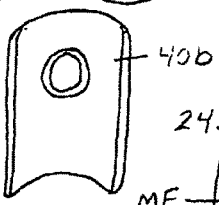
FIG. 18C is a rear view of the non-ornamental cap member for my crutch shown in FIG. 18A.
Figure 21A:
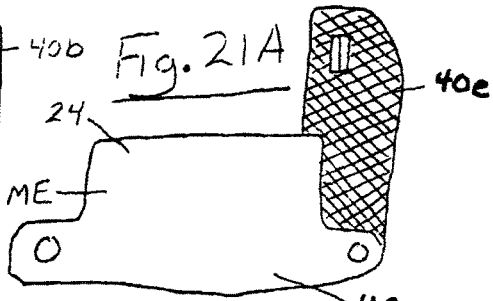
FIG. 21A is a front view of a bottom most connector element for my crutch having a built-in light.

As shown in FIGS. 17A and 17B, one accessory is a detachable rubber bumper structure 40*a*, which may provide an ornamental edifice, such as for example, a military insignia, a cartoon character, a corporate logo, etc. More importantly, the rubber structure avoids injury to the user if the crutch accidently falls on the user. FIGS. 18A and 18B depict a detachable planar end cap structure 40*b*, which may be made of rubber. FIGS. 19A and 19B depict another accessory that is a detachable battery powered audio alarm 40*c*. FIGS. 20A and 20B depict another accessory that is a detachable battery powered light. FIGS. 21A and 21B depict still depict another accessory that is a detachable member designed to be attached to the connector member 24.

As best shown in FIGS. 34 and 35, next to a slit 44 is a tab 43 sewn to an interior surface of the insulating material IM. The tabs are pulled through an adjacent slit to extend outward at a right angle to a pole. Adjacent tabs 43 include aligned openings 43*a* through which the fasteners 41 (FIG. 3) pass upon assembling the components of my crutch 10. As depicted in FIG. 3C, a cap member 41*a* is configured to be attached to the connector elements 22 and 24, and the cap member 41*b* is configured to be attached to the connector element 20. FIGS. 28, 29, 28A and 29A.

Figure 8:
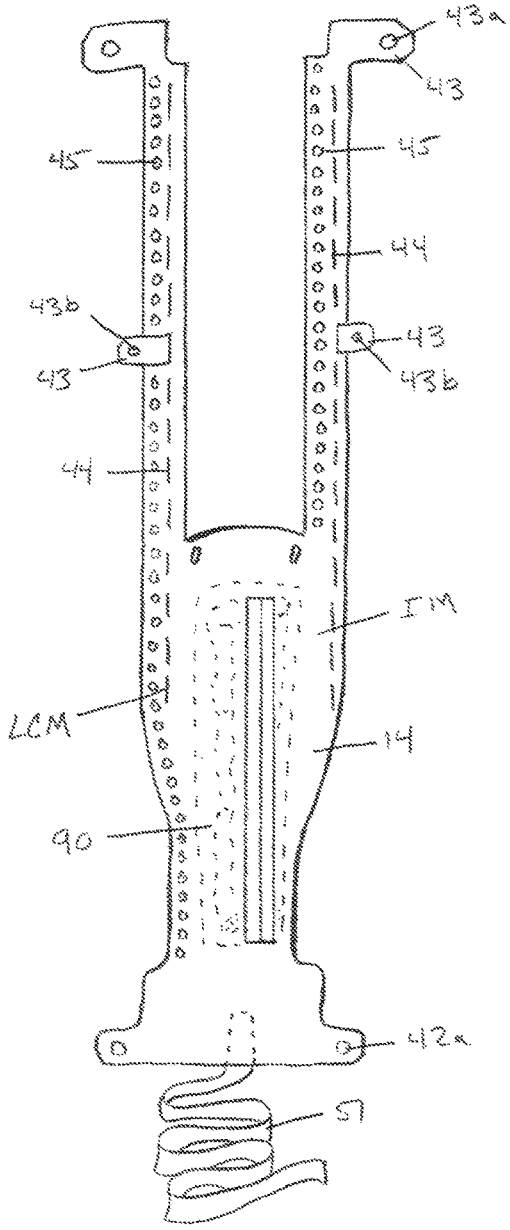
FIG. 8 is a front view of a first embodiment of an insulating sheath used with the embodiment of my crutch depicted in FIG. 3.
Figure 9:
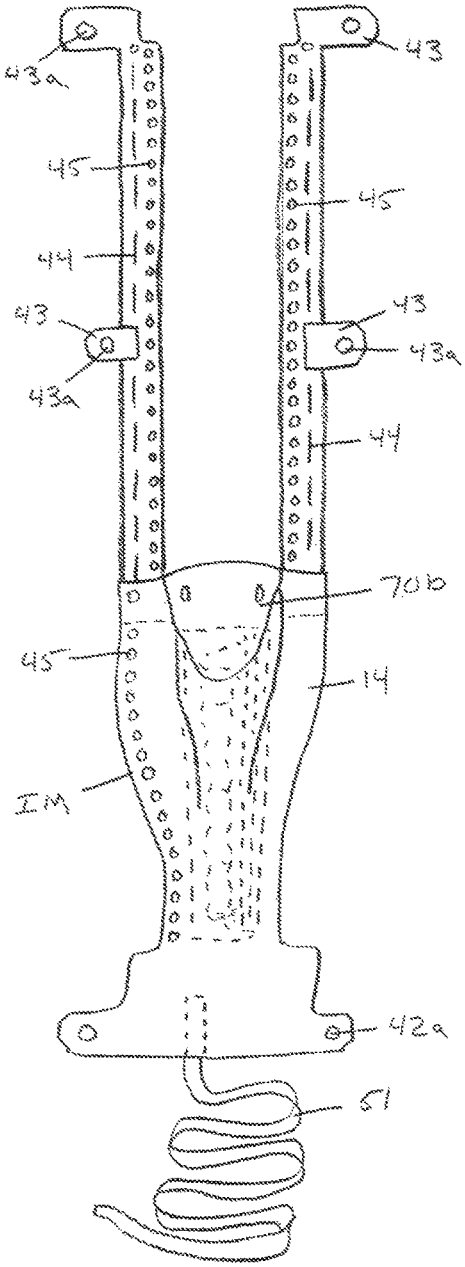
FIG. 9 is a rear view of a first embodiment of an insulating sheath used with the embodiment of my crutch depicted in FIG. 3.

As depicted in FIGS. 3, 4, 8 through 11, and 13A through 13C, the predetermined shaped sheet of insulating material IM is wrapped around to the assembly A and configured to at least partially cover the poles 20, 22, and 24, the underarm support member 20*a*, and the connector element 24. For example, the insulating material IM may be in two-parts: a top cover member TCM configured like glove that slips over the underarm support member 20*a* and a lower cover member in the form of a sheet LCM. A tail 51 made of insulating extends from the lower end of the sheet of insulating material IM. This tail 51 is wrapped around the lower end portion LEP of the center pole 16 between the tip cover 30 and the connector element 24. As illustrated in FIGS. 3 and 8, a pocket 60 (shown in dotted lines in FIG. 8) in the top cover member TCM may be employed for storing small items. This pocket 60 is above the connector element 22 connecting the side poles 12 and 16 and between the side poles 12 and 14. This pocket 60 has an open mouth 60*a* with a flap 2 that may be closed shut using Velcro® or other two-part connector. The open mouth 60*a* faces downward when the crutch 10 is in use. As depicted in FIG. 3A, another pocket 70 shown in dotted lines used to hold small items is between the side poles 12 and 14 beneath the connector handle element 22. It is formed in a lower portion of the sheet of insulating material IM covering the lower connector element 24, and it has an open mouth 70*a* (FIG. 3A). A closure flap 70*b* over an open mouth 70*a* is closed shut using Velcro® or other two-part connector. The open mouth 70*a* faces upward towards the connector handle element 22 when the crutch 10 is in use.

Figure 11:
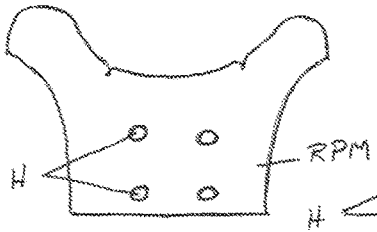
FIG. 11 is a front view of an resilient pad member without integral mounting members.
Figure 11A:
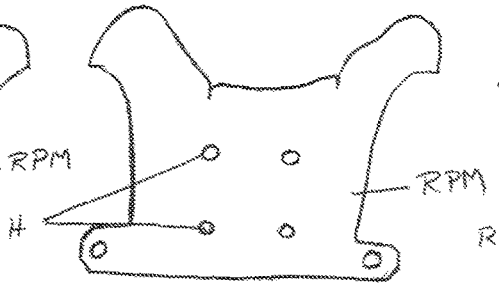
FIG. 11A is a front view of an resilient pad member with integral mounting members.
Figure 12:
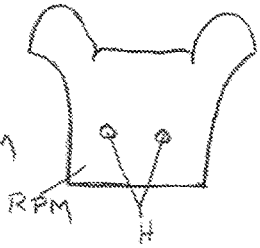
FIG. 12 is a front view of an resilient pad member sized used with a small simplified topmost connector element.
Figure 11:
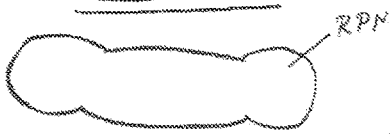
Figure 11A:
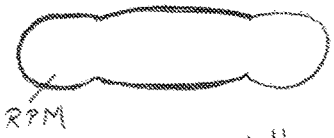
Figure 12A:
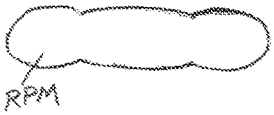
FIG. 12A is a top end view of the resilient pad member in FIG. 12.
Figure 11:
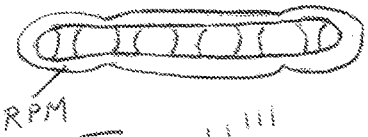
Figure 11A:
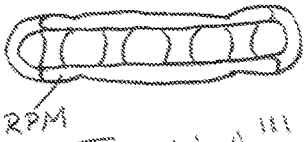
Figure 12B:
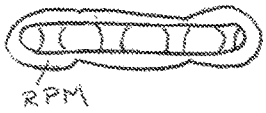
FIG. 12B is a bottom end view of the resilient pad member in FIG. 12.
Figure 11:
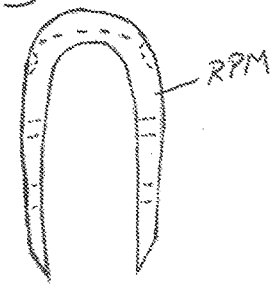
Figure 11A:
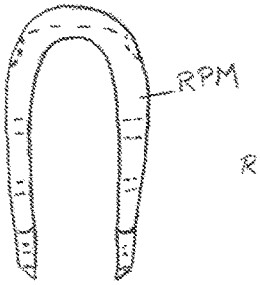
Figure 12C:
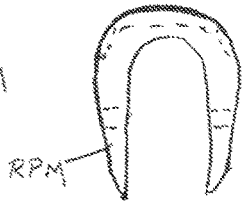
FIG. 12C is a side end view of the resilient pad member shown in FIG. 12.
Figure 13A:
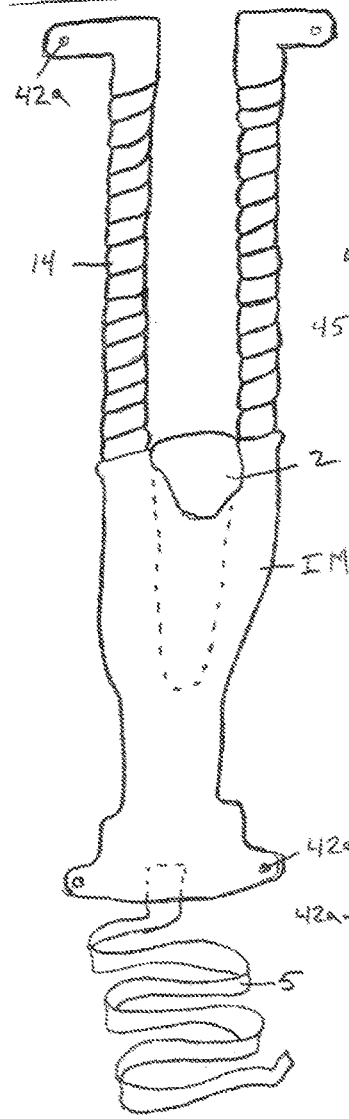
FIG. 13A is side view of a second embodiment of an insulating sheath used with my crutch.
Figure 13B:
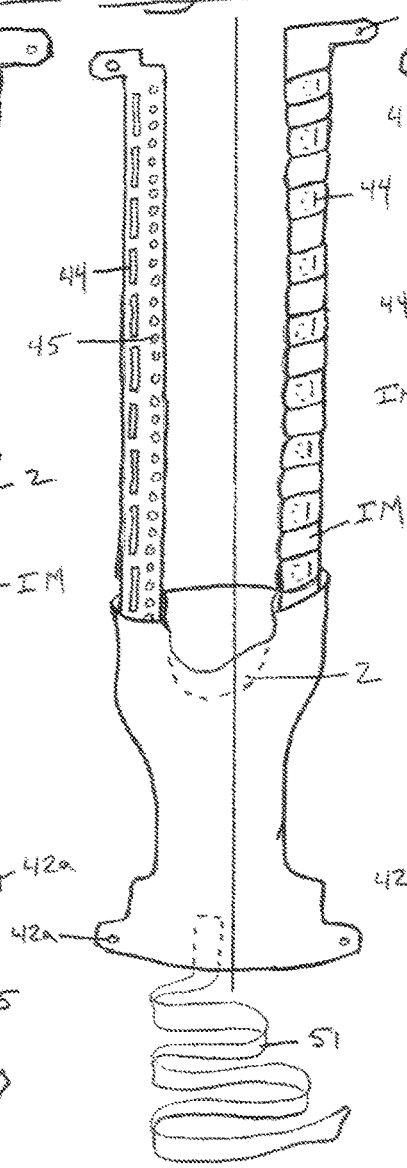
FIG. 13B is side view of a third embodiment of an insulating sheath used with my crutch.
Figure 13C:
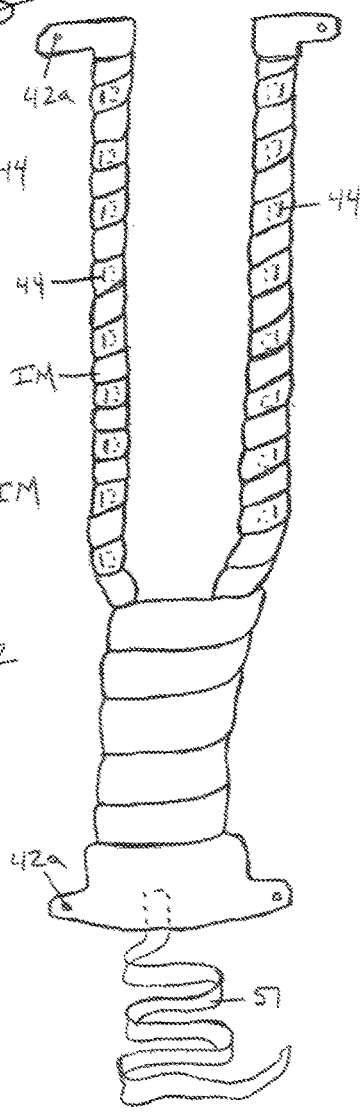
FIG. 13C is side view of a forth embodiment of an insulating sheath used with my crutch.

As best shown in FIGS. 11 through 12C, a resilient pad member RPM is used to cushion the crutch. The pad member is positioned under the user's arm within the armpit. This pad member RPM fits snugly over the connector element 22 and under the outer top portion of the insulating material. Three embodiments of the pad member RPM are illustrated in FIGS. 11, 11A, and FIG. 12, respectively, that have been covered by the insulating material IM. As best depicted in FIGS. 10 and 12A through C, the resilient pad member RPM includes a cavity 50*a* in a lower edge LE of the cover member. The cavity 50*a* has a configuration that conforms in shape to the external configuration the underarm support member body B. The resilient pad member RPM also has a predetermined external configuration like the configuration of the predetermined external configuration of the underarm support member body B. Thus the pad member RPM includes an upper edge 50*b* terminating at opposed ends in outwardly projecting finger elements 50*c* and 50*d* that are at an acute angle with respect to the reference line RL. The finger elements 50*c* and 50*d* form between them an indentation 50*e* in the upper edge 50*b*, with the individual elements 50*c* meeting the indentation at opposed ends of the indentation, forming individual junction grooves G.

As best shown in FIGS. 31 through 33B, an enclosure 90 holding a stretchable netting 91 may also be used with my crutch 10. The enclosure 90 may be built into an insulting sheath wrapped around the crutch 10, or is a detachable unit connected to the crutch 10*a* by cords 93 as depicted in FIGS. 31A and 32. In either case, the netting 91 has one end 91*a* fixed within the enclosure 90 and another end free 91*b*. As depicted in FIGS. 31A and 32, the detachably detachable unit is mounted to a lower portion of the crutch 10*a*. The enclosure 90 has a fin 95 extending lengthwise along a back wall of the enclosure 90 that fits snug with a slot 96 in the sheet of insulating material IM wrapped around the crutch 10*a*. Cords 97 enable the enclosure to be tied to my crutch.

A package held by the wrapped around netting 91 is positioned on an outer side OS (FIG. 31) of the crutch 10 or 10*a* when the user employs the crutch to aid in standing and walking. The user withdraws the free end 91*b* from the enclosure 90 through an opening such as a slit 94 in a sidewall 90*a* of the enclosure 90. The free end 91*b* is stretched into a configuration to be detachably connected to a portion of the crutch. For example, this free end 91*b* is pulled over the finger elements 50*c* and 50*d*.

The components of my crutch are assembled in a conventional manner, except for the upper portion of my crutch. Note, the connector 20, resilient pad member RPM, and the sheath part SH2 each have four holes H that are aligned and in registration with each upon assembly. The conventional fastener 41*d* shown in FIG. 4H is used to connect these assembled components together by inserting tube a into tube b of the fastener 41*d*.

The mounting elements ME and cap members 40 have predetermined dimensions enabling the cap members to be replaced or interchanged. The cap members 40 may be pain or marked with insignias, trademarks, corporate logos etc. as shown in FIG. 28A, or have unique ornamental shapes.

SCOPE OF THE INVENTION

The above presents a description of the best mode I contemplate of carrying out my crutch and method of use and of the manner and process of making and using my crutch and method of use, in such full, clear, concise, and exact terms as to enable a person skilled in the art to make and use. My crutch and method of use, however, are susceptible to modifications and alternate constructions from the illustrative embodiments discussed above which are fully equivalent. Consequently, it is not the intention to limit my crutch and method of use to the particular embodiments disclosed. On the contrary, my intention is to cover all modifications and alternate constructions coming within the spirit and scope of my crutch and method of use as generally expressed by the following claims, which particularly point out and distinctly claim the subject matter of my invention:

The invention claimed is:

1. A crutch comprising a pair of elongated, tubular metal side poles of the same length and shape, each pole having an upper portion terminating in a tip and a lower portion terminating in a tip, an elongated, tubular metal center pole positioned between the lower portions of the side poles and having an upper end portion and a lower end portion, the lower end portion of the central pole terminating in a tip that is inserted into a tip cover, said tip cover having a body forming a receptacle with a floor and open mouth that receives the tip of the center pole, said floor having a hard surface that engages the terminal tip of the center pole upon insertion and prevents the terminal tip from cutting into the body, beneath the surface a honey comb matrix of spaced apart open spaces in said body, spaced apart connector elements attaching together the side poles and center pole into an assembly where the center pole extends along a longitudinal central reference line and the side poles straddle said reference line and all the poles lie in the same plane and are parallel to each other, said spaced apart connector elements including (a) an underarm support member comprising a body having a bottom edge including a pair of open receptacles at outer ends of the bottom edge into which the tips of the upper portions of side poles are individually inserted, said underarm support member having a predetermined external configuration including opposed flat parallel faces between inwardly tapering side edges, an upper edge terminating at opposed ends in outwardly projecting finger elements that are at an acute angle with respect to the reference line, said finger elements forming between them an indentation in said upper edge, (b) a lower support member comprising a body having a central passageway and a pair of receptacles that straddle the central passageway, said central passageway lying along the reference line and through which the lower end portion of the center pole extends and the upper end portion of the center pole being sandwiched between the lower portions of the side poles, said receptacles terminating in a stop element that engage individual terminal tips of the lower portions of the side poles, and (c) an adjustable handle member intermediate the upper underarm support member and the lower support member extending between the side poles, said adjustable handle member configured to be detached and reconnected to different intermediate positions between said upper underarm support member and said lower support member, a resilient cover member that fits snugly over the upper underarm support member body and includes a cavity in a lower edge of the resilient cover member that has a configuration that conforms in shape to the external configuration the underarm support member body, an insulating material attached to the assembly and configured to at least partially cover the poles, the upper underarm support member, and the lower support member, and one or more of said connector elements having external cap members along the side poles.

2. The crutch of claim 1 where the resilient cover member has a predetermined external configuration like the configuration of the predetermined external configuration of the upper underarm support member body including an upper edge terminating at opposed ends in outwardly projecting finger elements that are at an acute angle with respect to the reference line, said finger elements forming between them an indentation in said upper edge, the individual fingers meeting the indentation at opposed ends of the indentation, forming individual junction grooves.

3. The crutch of claim 1 where the handle member is a molded rubber structure having a predetermined shape configured to conform to the grip of a user and has a handle cover comprising a resilient fabric that fits snugly over and covers at least partially the handle member.

4. The crutch of claim 1 where the handle member and center pole are mounted to be manually repositioned to accommodate users of different heights.

5. The crutch of claim 1 where the handle member is at a right angle with respect to the reference line.

6. A crutch comprising a pair of elongated, tubular metal side poles having upper and lower portions, an elongated, tubular metal center pole between lower portions of the side poles, spaced apart connector elements attaching together the side poles and center pole into an assembly where the center pole extends along a longitudinal central reference line and the side poles straddle said reference line and all the poles lie in the same plane and are parallel to each other, said spaced apart connector elements including an underarm support member attached to upper portions of side poles, a lower support member to which the lower portions of the side poles are attached, and a handle member intermediate the upper underarm support member, and one or more cap member connected to a mounting element extending from an edge of the assembly, said cap member having a flange and said mounting element having a slot, said flange and slot configured to enable the flange to slide to and from the slot.

7. A crutch comprising a pair of elongated, tubular metal side poles of the same length and shape, each pole having an upper portion terminating in a tip and a lower portion terminating in a tip, an elongated, tubular metal center pole positioned between the lower portions of the side poles and having an upper end portion and a lower end portion, said poles configured as an assembly having opposed external side edges, and where the center pole extends along a longitudinal central reference line and the side poles straddle said reference line, and all said poles lie in the same plane and are parallel to each other, a first connector element into which the tips of the upper portions of the side poles extend, a second connector element into which the tips of the lower portions of the side poles extend, a third connector element between the first and second connector elements that extends between the side poles and serves as a handle, and a plurality of cap members configured to reduce the likelihood of ensnaring an item that may contact the crutch, said third connector element and cap members interconnected, with the cap members projecting outwardly from said external side edges and mounted to be manually detached and reconnected and interchangeably mounted along a side edge of the crutch.

8. The crutch of claim 7 where the cap members includes one or more bumper structure comprising a resilient material.

9. A crutch comprising a pair of elongated, tubular metal side poles of the same length and shape, each pole having an upper portion terminating in a tip and a lower portion terminating in a tip, an elongated, tubular metal center pole positioned between the lower portions of the side poles and having an upper end portion and a lower end portion, spaced apart connector elements attaching together the side poles and center pole into an assembly where the center pole extends along a longitudinal central reference line and the side poles straddle said reference line, and all said poles lie in the same plane and are parallel to each other, said assembly having opposed external side edges from which mounting elements project outwardly, and a plurality of cap members connected to the mounting elements configured to reduce the likelihood of ensnaring an item that may contact the crutch, said spaced apart connector elements including (a) an underarm support member comprising a body having a bottom edge including a pair of open receptacles at outer ends of the bottom edge into which the tips of the upper portions of side poles are individually inserted, said underarm support member having a predetermined external configuration including opposed flat parallel faces between inwardly tapering side edges, an upper edge terminating at opposed ends in outwardly projecting finger elements that are at an acute angle with respect to the reference line, said finger elements forming between them an indentation in said upper edge, (b) a lower support member comprising a body having a central passageway and a pair of receptacles that straddle the central passageway, said central passageway lying along the reference line and through which the lower end portion of the center pole extends and the upper end portion of the center pole being sandwiched between the lower portions of the side poles, said receptacles terminating in a stop element that engage individual terminal tips of the lower portions of the side poles, and (c) an adjustable handle member intermediate the upper underarm support member and the lower support member extending between the side poles, said adjustable handle member configured to be detached and reconnected to different intermediate positions between said upper underarm support member and said lower support member.

10. The crutch of claim 9 where the lower end portion of the central pole terminates in a tip that is inserted into a tip cover, said tip cover having a body forming a receptacle with a floor and open mouth that receives the tip of the center pole, said floor having a hard surface that engages the terminal tip of the center pole upon insertion and prevents the terminal tip from cutting into the body, and beneath the surface a honey comb matrix of spaced apart open spaces in said body.

11. The crutch of claim 9 where the underarm support member of the crutch has a predetermined external configuration including an upper edge terminating at opposed ends in outwardly projecting finger elements that are at an acute angle with respect to the reference line, said finger elements forming between them an indentation in said upper edge, the individual fingers meeting the indentation at opposed ends of the indentation, forming individual junction grooves configured to mount a package.

12. The crutch of claim 9 where the lower support member of the crutch has a predetermined external configuration including an upper edge terminating at opposed ends in outwardly projecting finger elements that are at an acute angle with respect to the reference line, said finger elements forming between them an indentation in said upper edge, the individual fingers meeting the indentation at opposed ends of the indentation, forming individual junction grooves configured to mount a package.

* * * * *